US011199342B2

(12) United States Patent
Kamitani et al.

(10) Patent No.: US 11,199,342 B2
(45) Date of Patent: Dec. 14, 2021

(54) AIR CONDITIONER

(71) Applicant: DAIKIN INDUSTRIES, LTD., Osaka (JP)

(72) Inventors: Shigeki Kamitani, Osaka (JP); Masahiro Honda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 128 days.

(21) Appl. No.: 15/737,033

(22) PCT Filed: Jun. 15, 2016

(86) PCT No.: PCT/JP2016/067844
§ 371 (c)(1),
(2) Date: Dec. 15, 2017

(87) PCT Pub. No.: WO2016/204194
PCT Pub. Date: Dec. 22, 2016

(65) Prior Publication Data

US 2018/0372379 A1 Dec. 27, 2018

(30) Foreign Application Priority Data

Jun. 18, 2015 (JP) ..... JP2015-122891

(51) Int. Cl.
*F25B 1/00* (2006.01)
*F24F 11/89* (2018.01)
(Continued)

(52) U.S. Cl.
CPC ..... *F25B 1/005* (2013.01); *F24F 11/89* (2018.01); *F25B 5/02* (2013.01); *F25B 49/02* (2013.01);
(Continued)

(58) Field of Classification Search
CPC ..... F25B 1/005; F25B 2313/005; F24F 11/89
See application file for complete search history.

(56) References Cited

U.S. PATENT DOCUMENTS 8,176,743 B2 * 5/2012 Kurihara ..... F25B 9/008 62/190
10,670,282 B2 * 6/2020 Yamada ..... F25B 41/31
(Continued)

FOREIGN PATENT DOCUMENTS

EP 2068096 A1 6/2009
EP 2400229 A2 12/2011
(Continued)

OTHER PUBLICATIONS

JPH03230059A English Translation (Year: 1991).*
International Search Report for PCT/JP2016/067844 (PCT/ISA/210) dated Sep. 13, 2016.

*Primary Examiner* — Len Tran
*Assistant Examiner* — Jenna M Hopkins
(74) *Attorney, Agent, or Firm* — Birch, Stewart, Kolasch & Birch, LLP

(57) ABSTRACT

An air conditioner includes a liquid pressure adjusting expansion valve that is located in an outdoor liquid refrigerant pipe at a part thereof closer to a liquid refrigerant communication pipe than to a refrigerant cooler and configured to reduce a pressure of a refrigerant so that a refrigerant flows through the liquid refrigerant communication pipe in a gas-liquid two-phase state and so that the refrigerant flows through an outlet of a refrigerant cooler in a liquid state.

9 Claims, 8 Drawing Sheets

(51) Int. Cl.

| | |
|---|---|
| ***F25B 5/02*** | (2006.01) |
| ***F25B 49/02*** | (2006.01) |
| ***F25B 41/39*** | (2021.01) |
| ***F25B 40/02*** | (2006.01) |
| *F28D 7/10* | (2006.01) |

(52) U.S. Cl.

CPC ..... *F25B 40/02* (2013.01); *F25B 41/39* (2021.01); *F25B 2313/02741* (2013.01); *F25B 2400/13* (2013.01); *F25B 2600/2513* (2013.01); *F25B 2700/195* (2013.01); *F25B 2700/197* (2013.01); *F25B 2700/1931* (2013.01); *F25B 2700/1933* (2013.01); *F25B 2700/2106* (2013.01); *F25B 2700/21151* (2013.01); *F25B 2700/21152* (2013.01); *F25B 2700/21163* (2013.01); *F25B 2700/21171* (2013.01); *F25B 2700/21174* (2013.01); *F25B 2700/21175* (2013.01); *F28D 7/106* (2013.01)

(56) References Cited

U.S. PATENT DOCUMENTS

2005/0217292 A1* 10/2005 Onishi ..... F25B 49/02 62/197
2009/0255284 A1* 10/2009 Yoshimi ..... F24F 3/065 62/149
2009/0301117 A1* 12/2009 Setoguchi ..... F25B 9/008 62/208
2010/0180612 A1* 7/2010 Kasahara ..... F25B 13/00 62/225
2010/0275626 A1* 11/2010 Nishimura ..... F25B 49/005 62/149
2014/0223941 A1* 8/2014 Nishimura ..... F25B 49/02 62/190
2014/0326019 A1 11/2014 Kagawa et al.
2015/0300723 A1* 10/2015 Tsukino ..... F25B 47/025 62/128
2015/0323263 A1* 11/2015 Yanachi ..... F28F 1/40 165/154
2016/0097568 A1* 4/2016 Korenaga ..... F25B 49/02 62/160
2017/0217288 A1* 8/2017 Suzuki ..... B60H 1/00921
2017/0306952 A1* 10/2017 Choi ..... F04C 15/06
2017/0336085 A1* 11/2017 Yasuo ..... F25B 13/00
2019/0024914 A1* 1/2019 Yan ..... H05K 7/20827
2020/0116400 A1* 4/2020 Kojima ..... F16B 7/025
2020/0141609 A1* 5/2020 Nakagawa ..... F24F 1/00075
2020/0318875 A1* 10/2020 Yamada ..... F25B 49/02

FOREIGN PATENT DOCUMENTS

JP 63-197853 A 8/1988
JP H03230059 A * 10/1991 ..... F25B 2313/005
JP 5-332630 A 12/1993
JP 2005282972 A * 10/2005 ..... F25B 49/02
JP 2008-96093 A 4/2008
JP 2008-241125 A 10/2008
JP 2010-169309 A 8/2010
JP 2010-236834 A 10/2010
JP 2013-113559 A 6/2013
WO WO-2006057111 A1 * 6/2006 ..... F25B 13/00
WO WO-2009084519 A1 * 7/2009 ..... F25B 49/005
WO WO-2013099898 A1 * 7/2013 ..... F25B 1/005
WO WO-2013111177 A1 * 8/2013 ..... F24F 11/30
WO WO-2013179803 A1 * 12/2013 ..... F25B 13/00
WO WO-2014091612 A1 * 6/2014 ..... F25B 47/022
WO WO-2015182458 A1 * 12/2015 ..... F25B 13/00

* cited by examiner

AIR CONDITIONER

TECHNICAL FIELD

The present invention relates to an air conditioner, and in particular to an air conditioner that includes a refrigerant circuit configured by connecting, via a liquid refrigerant communication pipe and a gas refrigerant communication pipe, an outdoor unit having a compressor and an outdoor heat exchanger and a plurality of indoor units each having an indoor expansion valve and an indoor heat exchanger, with a refrigerant filled into the refrigerant circuit being circulated through in the sequence of the compressor, the outdoor heat exchanger, the liquid refrigerant communication pipe, the indoor expansion valve, the indoor heat exchanger, the gas refrigerant communication pipe, and the compressor.

BACKGROUND ART

In the background art, there are air conditioners each including a refrigerant circuit configured by connecting, via a liquid refrigerant communication pipe and a gas refrigerant communication pipe, an outdoor unit having a compressor and an outdoor heat exchanger and an indoor unit having an indoor heat exchanger. As such an air conditioner, as described in Patent Literature 1 and Patent Literature 2 (Japanese Unexamined Patent Application Publication No. S63-197853 and Japanese Unexamined Patent Application Publication No. H5-332630), there is an air conditioner employing a configuration in which, during a cooling operation when a refrigerant filled into a refrigerant circuit is circulated through in the sequence of a compressor, an outdoor heat exchanger, a liquid refrigerant communication pipe, an indoor heat exchanger, a gas refrigerant communication pipe, and a compressor, an outdoor expansion valve or a capillary tube connected to the liquid-side end of the outdoor heat exchanger is used to reduce the pressure of the refrigerant before the refrigerant is sent to the liquid refrigerant communication pipe. Then, by employing such a configuration, the refrigerant flowing through the liquid refrigerant communication pipe enters in a gas-liquid two-phase state, to achieve reduction in amount of the refrigerant to be filled into the refrigerant circuit.

In addition, in the background art, as described in Patent Literature 3 (Japanese Unexamined Patent Application Publication No. 2010-236834), in another air conditioner including a refrigerant circuit configured by connecting, via a liquid refrigerant communication pipe and a gas refrigerant communication pipe, an outdoor unit having a compressor and an outdoor heat exchanger and a plurality of indoor units each having an indoor expansion valve and an indoor heat exchanger, a subcooling heat exchanger (refrigerant cooler) and a subcooling branching pipe (refrigerant returning pipe) are provided. Here, the refrigerant returning pipe is connected to an outdoor liquid refrigerant pipe, which connects the liquid-side end of the outdoor heat exchanger and the liquid refrigerant communication pipe, so that a portion of the refrigerant flowing through the outdoor liquid refrigerant pipe is branched off and returned to the compressor, and the refrigerant cooler is configured to cool the refrigerant flowing through the outdoor liquid refrigerant pipe using the refrigerant flowing through the refrigerant returning pipe.

SUMMARY OF THE INVENTION

Here, in the air conditioner of the above latter case that includes a refrigerant circuit having a refrigerant returning pipe and a refrigerant cooler, the refrigerant in a liquid state is sent from the outdoor unit to the indoor unit via the liquid refrigerant communication pipe during a cooling operation, and then the indoor expansion valve located in the indoor unit is used to reduce the pressure of the refrigerant. As a result, in the configuration of the latter case, the amount of the refrigerant to be filled into the refrigerant circuit is increased by an amount of the refrigerant in a liquid state for filling the liquid refrigerant communication pipe.

To overcome this problem, even in the configuration of the latter of the air conditioners described above, a configuration can be adopted in which an outdoor expansion valve or a capillary tube connected to the liquid-side end of the outdoor heat exchanger of the former air conditioners described above is used to lower the pressure of the refrigerant in order to reduce the amount of the refrigerant to be filled into the refrigerant circuit.

However, when employing the configuration of the former of the air conditioners described above in the configuration of the latter of the air conditioners described above, the pressure of the refrigerant flowing through the refrigerant cooler falls due to a reduction in pressure of the refrigerant using the outdoor expansion valve or the capillary tube connected to the liquid-side end of the outdoor heat exchanger, and it becomes impossible to flow the refrigerant with a high level of wetness through the refrigerant cooler. In addition, the configuration makes it difficult to secure a difference in pressure between the refrigerant flowing through the outdoor liquid refrigerant pipe and the refrigerant flowing through the refrigerant returning pipe. As a result, the cooling function of the refrigerant cooler is no longer able to be adequately fulfilled, which can degrade the refrigeration capacity and operating efficiency of the entire air conditioner.

The problem the present invention addresses is, in an air conditioner including a refrigerant circuit configured by connecting, via a liquid refrigerant communication pipe and a gas refrigerant communication pipe, an outdoor unit having a compressor and an outdoor heat exchanger and a plurality of indoor units each having an indoor expansion valve and an indoor heat exchanger, to reduce the amount of a refrigerant to be filled into the refrigerant circuit while achieving improvement of the refrigeration capacity and operating efficiency using a refrigerant returning pipe and a refrigerant cooler.

An air conditioner according to a first aspect of the present invention is an air conditioner that includes a refrigerant circuit configured by connecting, via a liquid refrigerant communication pipe and a gas refrigerant communication pipe, an outdoor unit having a compressor and an outdoor heat exchanger and a plurality of indoor units each having an indoor expansion valve and an indoor heat exchanger, and a refrigerant filled into the refrigerant circuit is circulated through in the sequence of the compressor, the outdoor heat exchanger, the liquid refrigerant communication pipe, the indoor expansion valve, the indoor heat exchanger, the gas refrigerant communication pipe, and the compressor. Then, here, a refrigerant returning pipe that branches off a portion of the refrigerant flowing through an outdoor liquid refrigerant pipe and returns the portion of the refrigerant to the compressor is connected to the outdoor liquid refrigerant pipe that connects a liquid-side end of the outdoor heat exchanger and the liquid refrigerant communication pipe, and the outdoor liquid refrigerant pipe is provided with a refrigerant cooler that is configured to cool the refrigerant flowing through the outdoor liquid refrigerant pipe using the refrigerant flowing through the refrigerant returning pipe.

Moreover, here, a liquid pressure adjusting expansion valve configured to reduce a pressure of the refrigerant is located in the outdoor liquid refrigerant pipe at a part thereof between the liquid refrigerant communication pipe and the refrigerant cooler so that the refrigerant flows through the liquid refrigerant communication pipe in a gas-liquid two-phase state and so that the refrigerant flows through an outlet of the refrigerant cooler in a liquid state.

Here, as described above, to reduce the pressure of the refrigerant so that the refrigerant flowing through the liquid refrigerant communication pipe enters a gas-liquid two-phase state, the liquid pressure adjusting expansion valve is located in the outdoor liquid refrigerant pipe, which connects the liquid-side end of the outdoor heat exchanger and the liquid refrigerant communication pipe, at the part thereof between the liquid refrigerant communication pipe and the refrigerant cooler, and thereby a reduction in the pressure of the refrigerant flowing through the outdoor liquid refrigerant pipe is achieved so that the refrigerant flows through the liquid refrigerant communication pipe in a gas-liquid two-phase state and so that the refrigerant flows through the outlet of the refrigerant cooler in a liquid state.

Because of this configuration, here, the pressure of the refrigerant flowing through the refrigerant cooler is unlikely to fall and the refrigerant can flow with a high level of wetness through the refrigerant cooler, and a difference in pressure between the refrigerant flowing through the outdoor liquid refrigerant pipe and the refrigerant flowing through the refrigerant returning pipe can be easily secured, and therefore, a cooling function can be adequately fulfilled in the refrigerant cooler. As a result, the flow rate of the refrigerant sent to the plurality of indoor units can be reduced and the loss in pressure in the gas refrigerant communication pipe and the like can be decreased, improving the refrigeration capacity and operating efficiency.

In this manner, here, in an air conditioner including a refrigerant circuit configured by connecting, via a liquid refrigerant communication pipe and a gas refrigerant communication pipe, an outdoor unit having a compressor and an outdoor heat exchanger and a plurality of indoor units each having an indoor expansion valve and an indoor heat exchanger, it is possible to reduce the amount of the refrigerant to be filled into the refrigerant circuit while the refrigeration capacity and operating efficiency using a refrigerant returning pipe and a refrigerant cooler are improved.

An air conditioner according to a second aspect of the present invention is the air conditioner according to the first aspect of the present invention, and the outdoor unit and/or the plurality of indoor units have a control unit that is configured to control constituent components of the air conditioner including the liquid pressure adjusting expansion valve. Then, here, the control unit uses the liquid pressure adjusting expansion valve to reduce the pressure of the refrigerant so that the refrigerant flows through the liquid refrigerant communication pipe in the gas-liquid two-phase state and so that the refrigerant flows through the outlet of the refrigerant cooler in the liquid state, by controlling an opening degree of the liquid pressure adjusting expansion valve such that a subcooling degree of the refrigerant at the liquid-side end of the outdoor heat exchanger reaches a target subcooling degree.

Here, the opening degree of the liquid pressure adjusting expansion valve is controlled such that the subcooling degree of the refrigerant at the liquid-side end of the outdoor heat exchanger reaches the target subcooling degree as described above, and therefore, it is easier to maintain the refrigerant in the liquid state to flow through the outdoor liquid refrigerant pipe at a part thereof between the outdoor heat exchanger and the liquid pressure adjusting expansion valve, which enables reliable flow of the refrigerant with a high level of wetness through the refrigerant cooler.

An air conditioner according to a third aspect of the present invention is the air conditioner according to the second aspect of the present invention, and it further includes a liquid-side outdoor heat exchange sensor that is located in the outdoor liquid refrigerant pipe at the part thereof between the outdoor heat exchanger and the refrigerant cooler and configured to detect a temperature of the refrigerant. Then, here, the control unit obtains the subcooling degree of the refrigerant at the liquid-side end of the outdoor heat exchanger from the temperature of the refrigerant detected by the liquid-side outdoor heat exchange sensor.

Here, the subcooling degree of the refrigerant at the liquid-side end of the outdoor heat exchanger can be obtained accurately using the liquid-side outdoor heat exchange sensor that is located in the outdoor liquid refrigerant pipe at the part thereof between the outdoor heat exchanger and the refrigerant cooler as described above, and therefore, the liquid pressure adjusting expansion valve can be controlled in a precise manner.

An air conditioner according to a fourth aspect of the present invention is the air conditioner according to the first aspect of the present invention, and the outdoor unit and/or the plurality of indoor units have a control unit configured to control the constituent components of the air conditioner including the liquid pressure adjusting expansion valve. Then, here, the control unit uses the liquid pressure adjusting expansion valve to reduce the pressure of the refrigerant so that the refrigerant flows through the liquid refrigerant communication pipe in the gas-liquid two-phase state and so that the refrigerant flows through the outlet of the refrigerant cooler in the liquid state, by controlling an opening degree of the liquid pressure adjusting expansion valve such that a pressure of the refrigerant in the outdoor liquid refrigerant pipe at a part thereof provided with the refrigerant cooler reaches a target liquid pressure.

Here, the opening degree of the liquid pressure adjusting expansion valve is controlled such that the pressure of the refrigerant in the outdoor liquid refrigerant pipe at the part thereof provided with the refrigerant cooler reaches the target liquid pressure as described above, and therefore, it is possible to maintain the pressure of the refrigerant flowing through the refrigerant cooler to be high, which enables reliable flow of the refrigerant with a high level of wetness through the refrigerant cooler.

An air conditioner according to a fifth aspect of the present invention is the air conditioner according to the fourth aspect of the present invention, and it further includes a refrigerant cooling-side sensor that is located in the outdoor liquid refrigerant pipe at a part thereof between the outdoor heat exchanger and the liquid pressure adjusting expansion valve, and configured to detect a pressure of the refrigerant or a state quantity equivalent to the pressure. Then, here, the control unit obtains a pressure of the refrigerant in the outdoor liquid refrigerant pipe at the part thereof provided with the refrigerant cooler from the pressure of the refrigerant or the state quantity equivalent to the pressure detected by the refrigerant cooling-side sensor.

Here, the pressure of the refrigerant in the outdoor liquid refrigerant pipe at the part thereof provided with the refrigerant cooler can be obtained accurately using the refrigerant cooling-side sensor located in the outdoor liquid refrigerant pipe at the part thereof between the outdoor heat exchanger and the liquid pressure adjusting expansion valve as described above, and therefore, the liquid pressure adjusting expansion valve can be controlled in a precise manner.

An air conditioner according to a sixth aspect of the present invention is the air conditioner according to the fourth or fifth aspect of the present invention, and it further includes an outdoor expansion valve that is located in the outdoor liquid refrigerant pipe at a part thereof between the outdoor heat exchanger and the refrigerant cooler. Then, here, the control unit uses the liquid pressure adjusting expansion valve to reduce the pressure of the refrigerant so that the refrigerant flows through the liquid refrigerant communication pipe in the gas-liquid two-phase state and so that the refrigerant flows through the outlet of the refrigerant cooler in the liquid state, by controlling an opening degree of the outdoor expansion valve such that a subcooling degree of the refrigerant at the liquid-side end of the outdoor heat exchanger reaches a target subcooling degree, and by controlling the opening degree of the liquid pressure adjusting expansion valve such that the pressure of the refrigerant in the outdoor liquid refrigerant pipe at the part thereof provided with the refrigerant cooler reaches the target liquid pressure.

Here, by locating the outdoor expansion valve in the outdoor liquid refrigerant pipe at the part thereof between the outdoor heat exchanger and the refrigerant cooler, the opening degree of the outdoor expansion valve is controlled such that the subcooling degree of the refrigerant at the liquid-side end of the outdoor heat exchanger reaches the target subcooling degree as described above. As a result, the pressure of the refrigerant in the outdoor liquid refrigerant pipe is likely to fall at the part thereof provided with the refrigerant cooler. Therefore, here, the opening degree of the liquid pressure adjusting expansion valve is controlled such that the pressure of the refrigerant in the outdoor liquid refrigerant pipe at the part thereof provided with the refrigerant cooler reaches the target liquid pressure as described above.

Due to this configuration, here, although the outdoor expansion valve reduces the pressure of the refrigerant flowing through in the outdoor liquid refrigerant pipe at the part thereof between the outdoor heat exchanger and the refrigerant cooler, it is possible to maintain the pressure of the refrigerant flowing through the refrigerant cooler to be high, which enables reliable flow of the refrigerant with a high level of wetness through the refrigerant cooler.

An air conditioner according to a seventh aspect of the present invention is the air conditioner according to the sixth aspect of the present invention, and it further includes a liquid-side outdoor heat exchange sensor that is located in the outdoor liquid refrigerant pipe at a part thereof between the outdoor heat exchanger and the outdoor expansion valve and configured to detect a temperature of the refrigerant, and a refrigerant cooling-side sensor to detect a pressure of the refrigerant or a state quantity equivalent to the pressure is located in the outdoor liquid refrigerant pipe at a part thereof between the outdoor expansion valve and the liquid pressure adjusting expansion valve. Then, here, the control unit obtains a subcooling degree of the refrigerant at the liquid-side end of the outdoor heat exchanger from the temperature of the refrigerant detected by the liquid-side outdoor heat exchange sensor, and obtains the pressure of the refrigerant in the outdoor liquid refrigerant pipe at the part thereof provided with the refrigerant cooler from the pressure of the refrigerant or the state quantity equivalent to the pressure detected by the refrigerant cooling-side sensor.

Here, the subcooling degree of the refrigerant at the liquid-side end of the outdoor heat exchanger can be accurately obtained using the liquid-side outdoor heat exchange sensor located in the outdoor liquid refrigerant pipe at the part thereof between the outdoor heat exchanger and the outdoor expansion valve, and also the pressure of the refrigerant in the outdoor liquid refrigerant pipe at the part thereof provided with the refrigerant cooler can be correctly obtained using the refrigerant cooling-side sensor located in the outdoor liquid refrigerant pipe at the part thereof between the outdoor expansion valve and the liquid pressure adjusting expansion valve as described above, and therefore, it is possible to perform control of the outdoor expansion valve and the liquid pressure adjusting expansion valve in a precise manner.

An air conditioner according to an eighth aspect of the present invention is the air conditioner according to the sixth or seventh aspect of the present invention, and when the control unit controls the opening degree of the liquid pressure adjusting expansion valve such that the pressure of the refrigerant in the outdoor liquid refrigerant pipe at the part thereof provided with the refrigerant cooler reaches the target liquid pressure, the control unit controls the liquid pressure adjusting expansion valve in a range of a lower limit opening degree or higher and revises the lower limit opening degree according to the opening degree of the outdoor expansion valve.

Here, when the opening degree of the outdoor expansion valve is controlled such that the subcooling degree of the refrigerant at the liquid-side end of the outdoor heat exchanger reaches the target subcooling degree and the opening degree of the liquid pressure adjusting expansion valve is controlled such that the pressure of the refrigerant in the outdoor liquid refrigerant pipe at the part thereof provided with the refrigerant cooler reaches the target liquid pressure as described above, the controls of the both of the expansion valves are likely to affect each other, which tends to make the opening degrees of both of the expansion valves unstable. For example, when the opening degree of the outdoor expansion valve is controlled to increase in a state where the outdoor expansion valve and the liquid pressure adjusting expansion valve are stabilized with certain opening degrees (that is, a state of being stabilized at the target subcooling degree and the target liquid pressure), the pressure of the refrigerant on the downstream side of the outdoor expansion valve (that is, in the outdoor liquid refrigerant pipe at a part thereof between the outdoor expansion valve and the liquid pressure adjusting expansion valve) is changed to increase. The change in pressure of the refrigerant caused by the change in the opening degree of the outdoor expansion valve occurs considerably suddenly, and swift control of the opening degree of the liquid pressure adjusting expansion valve is required, but if the control sensitivity is excessively raised, the stability is impaired. As a result, the opening degree of the liquid pressure adjusting expansion valve, and furthermore, the opening degrees of both of the expansion valves are likely to be unstable. Therefore, here, in controlling the liquid pressure adjusting expansion valve, the changeable range of opening degrees is restricted to the lower limit opening degree or higher, and the lower limit opening degree is revised according to the opening degree of the outdoor expansion valve as described above, so that the control sensitivity is not excessively raised, but the change in pressure of the refrigerant on the downstream side of the outdoor expansion valve (that is, in the outdoor liquid refrigerant pipe at the part thereof between the outdoor expansion valve and the liquid pressure adjusting expansion valve) caused by controlling the opening degree of the outdoor expansion valve can be swiftly followed.

Due to this configuration, here, although the control of the opening degree of the outdoor expansion valve and the control of the opening degree of the liquid pressure adjusting expansion valve are likely to affect each other, both of the expansion valves can be controlled with good follow-up performance and stability.

An air conditioner according to a ninth aspect of the present invention is the air conditioner according to any one of the first to eighth aspects of the present invention, and the refrigerant returning pipe is a refrigerant pipe that sends the refrigerant branched off from the outdoor liquid refrigerant pipe to a suction side of the compressor.

Here, the refrigerant returning pipe is the refrigerant pipe that sends the refrigerant branched off from the outdoor liquid refrigerant pipe to the suction side of the compressor as described above, which provides the refrigerant cooler with a cooling function that is obtained by utilizing the difference in pressure between the pressure of the refrigerant flowing through the outdoor liquid refrigerant pipe and the low pressure of the refrigeration cycle.

An air conditioner according to a tenth aspect of the present invention is the air conditioner according to any one of the first to eighth aspects of the present invention, and the refrigerant returning pipe is a refrigerant pipe that sends the refrigerant branched off from the outdoor liquid refrigerant pipe into a middle of a compression process in the compressor.

Here, the refrigerant returning pipe is the refrigerant pipe that sends the refrigerant branched off from the outdoor liquid refrigerant pipe into the middle of the compression process in the compressor as described above, which provides the refrigerant cooler with a cooling function that is obtained by utilizing the difference in pressure between the pressure of the refrigerant flowing through the outdoor liquid refrigerant pipe and the intermediate pressure of the refrigeration cycle.

DESCRIPTION OF EMBODIMENTS

Below, an embodiment of an air conditioner according to the present invention will be described based on the drawings. Note that the specific configuration of an embodiment of the air conditioner according to the present invention is not limited by the following embodiment and modified examples, and modifications are possible without departing from the scope of the invention.

(1) Configuration of Air Conditioner

Figure 1:
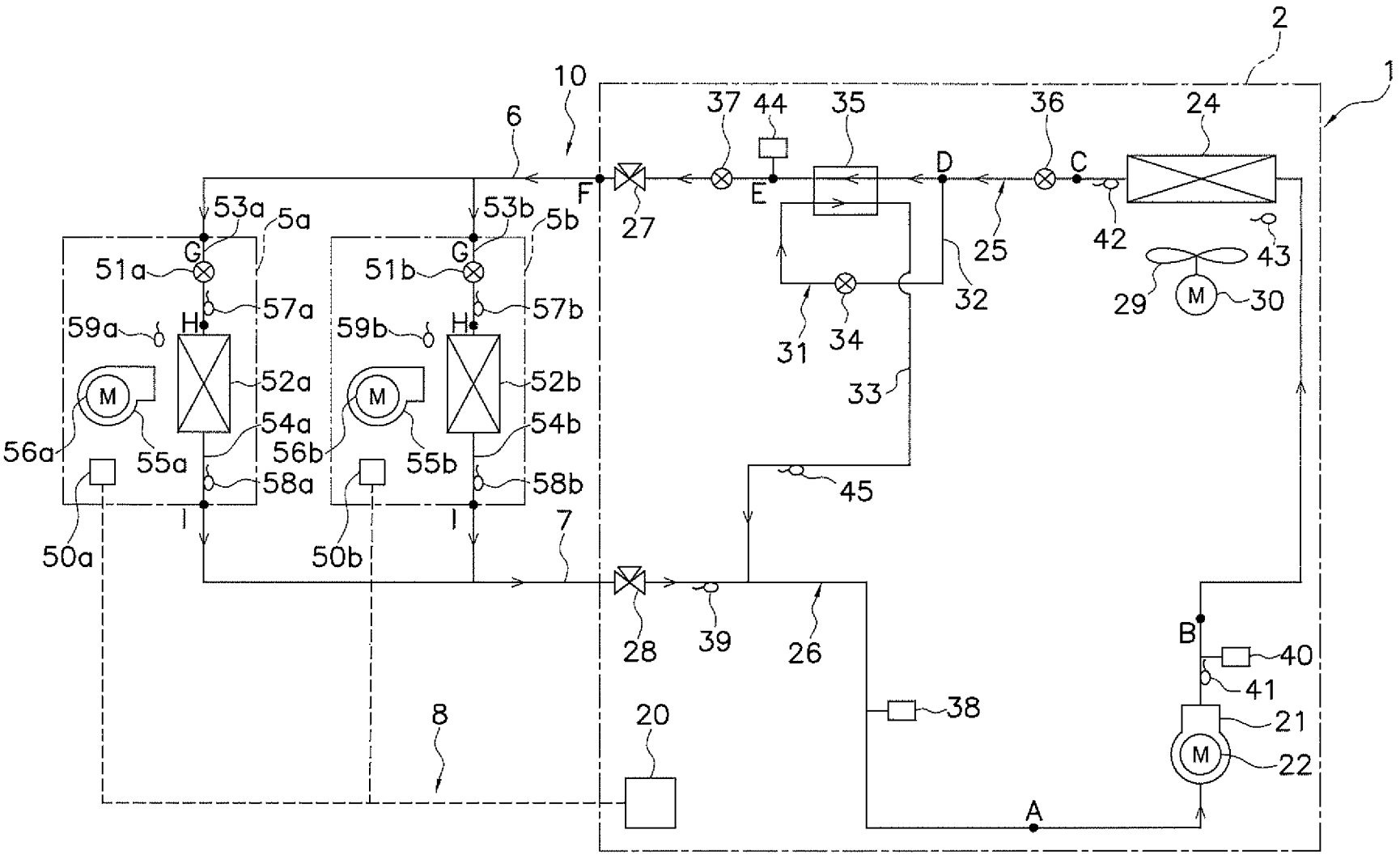
FIG. 1 is a schematic configuration diagram of an air conditioner according to one embodiment of the present invention (with illustration of the flow of refrigerant during a cooling operation).

FIG. 1 is a schematic configuration diagram of an air conditioner 1 according to one embodiment of the present invention. The air conditioner 1 is a device for cooling interiors of buildings and the like using a vapor-compression type refrigeration cycle. The air conditioner 1 mainly includes an outdoor unit 2, a plurality of (two in this embodiment) indoor units 5*a* and 5*b* connected in parallel to each other, and a liquid refrigerant communication pipe 6 and a gas refrigerant communication pipe 7 both connecting the outdoor unit 2 and the indoor units 5*a* and 5*b*. A vapor-compression type refrigerant circuit 10 of the air conditioner 1 is configured by connecting the outdoor unit 2 and the indoor units 5*a* and 5*b* via the liquid refrigerant communication pipe 6 and the gas refrigerant communication pipe 7.

<Indoor Units>

The indoor units 5*a* and 5*b* are disposed inside of a building or the like. As described above, the indoor units 5*a* and 5*b* are connected to the outdoor unit 2 via the liquid refrigerant communication pipe 6 and the gas refrigerant communication pipe 7, and constitute a part of the refrigerant circuit 10.

Next, the configuration of the indoor units 5*a* and 5*b* will be described. Note that the indoor unit 5*a* and the indoor unit 5*b* have the same configuration, and therefore, only the configuration of the indoor unit 5*a* will be described here, and the suffix "b" will be added with regard to the configuration of the indoor unit 5*b* instead of the suffix "a" indicating elements of the indoor unit 5*a*, and the description of each of the elements of the indoor unit 5*b* will be omitted.

The indoor unit 5*a* mainly includes an indoor expansion valve 51*a* and an indoor heat exchanger 52*a*. The indoor unit 5*a* further includes an indoor liquid refrigerant pipe 53*a* connecting the liquid-side end of the indoor heat exchanger 52*a* and the liquid refrigerant communication pipe 6, and an indoor gas refrigerant pipe 54*a* connecting the gas-side end of the indoor heat exchanger 52*a* and the gas refrigerant communication pipe 7.

The indoor expansion valve 51*a* is an electric expansion valve for adjusting the flow rate of a refrigerant flowing through the indoor heat exchanger 52*a* while reducing the pressure of the refrigerant to a low pressure of the refrigeration cycle, and is located in the indoor liquid refrigerant pipe 53*a*.

The indoor heat exchanger 52*a* is a heat exchanger that functions as an evaporator of the refrigerant at the low pressure of the refrigeration cycle, to cool indoor air. Here, the indoor unit 5*a* has an indoor fan 55*a* that suctions the indoor air into the indoor unit 5*a* for heat exchange of the air with the refrigerant in the indoor heat exchanger 52*a* to supply it as supply air to the indoor. That is, the indoor unit 5*a* has the indoor fan 55*a* as a fan for supplying the indoor air that serves as a cooling source for the refrigerant flowing through the indoor heat exchanger 52*a* to the indoor heat exchanger 52*a*. Here, a centrifugal fan, a multi-blade fan, or the like driven by an indoor fan motor 56*a* may be used as the indoor fan 55*a*. In addition, here, the number of rotations of the indoor fan motor 56*a* is controllable by an inverter or the like, which makes the air volume of the indoor fan 55*a* controllable.

The indoor unit 5*a* is provided with various types of sensors. More specifically, the indoor unit 5*a* is provided with a liquid-side indoor heat exchange sensor 57*a* for detecting a temperature Trl of the refrigerant at the liquid-side end of the indoor heat exchanger 52*a*, a gas-side indoor heat exchange sensor 58*a* for detecting a temperature Trg of the refrigerant at the gas-side end of the indoor heat exchanger 52*a*, and an indoor air sensor 59*a* for detecting a temperature Tra of the indoor air suctioned into the indoor unit 5*a*.

The indoor unit 5*a* includes an indoor-side controller 50*a* for controlling the operations of each of components that constitute the indoor unit 5*a*. The indoor-side controller 50*a* includes a microcomputer, a memory, and the like that are provided to perform individual control of the indoor unit 5*a*, such that exchanging of control signals and the like is enabled with a remote control (not shown) for individually manipulating the indoor unit 5*a*, and exchanging of control signals and the like is enabled with the outdoor unit 2 via a communication line.

<Outdoor Unit>

The outdoor unit 2 is disposed externally on a building or the like. As described above, the outdoor unit 2 is connected to the indoor unit 5*a* and 5*b* via the liquid refrigerant communication pipe 6 and the gas refrigerant communication pipe 7 and constitutes a part of the refrigerant circuit 10.

Next, the configuration of the outdoor unit 2 will be described.

The outdoor unit 2 mainly includes a compressor 21 and an outdoor heat exchanger 24. The outdoor unit 2 further includes an outdoor liquid refrigerant pipe 25 connecting the liquid-side end of the outdoor heat exchanger 24 and the liquid refrigerant communication pipe 6, and an outdoor gas refrigerant pipe 26 connecting the suction side of the compressor 21 and the gas refrigerant communication pipe 7. A liquid-side shutoff valve 27 is located at the connecting part of the outdoor liquid refrigerant pipe 25 with the liquid refrigerant communication pipe 6, and a gas side shutoff valve 28 is located at the connecting part of the outdoor gas refrigerant pipe 26 with the gas refrigerant communication pipe 7. The liquid side shutoff valve 27 and the gas side shutoff valve 28 are valves that are manually opened and closed.

The compressor 21 is a device for compressing the refrigerant in the refrigeration cycle to increase a low pressure thereof to a high pressure. Here, as the compressor 21, a compressor with a tightly sealed structure, where a positive-displacement compressor element of a rotary type, a scrolling type, or the like (not shown) is rotationally driven by a compressor motor 22 is used. In addition, here, the number of rotations of the compressor motor 22 is controllable by an inverter or the like, which makes the capacity of the compressor 21 controllable.

The outdoor heat exchanger 24 is a heat exchanger that functions as a radiator for the refrigerant at a high pressure in the refrigeration cycle. Here, the outdoor unit 2 includes an outdoor fan 29 for suctioning outside air into the outdoor unit 2 and discharging the outside air to the outside after heat exchange of the outside air with the refrigerant has been carried out in the outdoor heat exchanger 24. That is, the outdoor unit 2 has the outdoor fan 29 as a fan for supplying the outside air to the outdoor heat exchanger 24, the air being to serve as the cooling source for the refrigerant flowing through the outdoor heat exchanger 24. Here, as the outdoor fan 29, a propeller fan or the like that is driven by an outdoor fan motor 30 is used. In addition, here, the number of rotations of the outdoor fan motor 30 is controllable by an inverter or the like, which makes the air volume of the outdoor fan 29 is controllable.

The refrigerant filled into the refrigerant circuit 10 is to be circulated through in the sequence of the compressor 21, the outdoor heat exchanger 24, the liquid refrigerant communication pipe 6, the indoor expansion valves 51*a* and 51*b*, the indoor heat exchangers 52*a* and 52*b*, the gas refrigerant communication pipe 7, and the compressor 21.

In addition, here, the outdoor liquid refrigerant pipe 25 is connected to a refrigerant returning pipe 31, and is provided with a refrigerant cooler 35 and an outdoor expansion valve 36. The refrigerant returning pipe 31 is a refrigerant pipe for branching off a portion of the refrigerant flowing through the outdoor liquid refrigerant pipe 25 and returning this portion of the refrigerant to the compressor 21. The refrigerant cooler 35 is a heat exchanger for cooling the refrigerant flowing through the outdoor liquid refrigerant pipe 25 using the refrigerant flowing through the refrigerant returning pipe 31. The outdoor expansion valve 36 is an electric expansion valve located in the outdoor liquid refrigerant pipe 25 at a part thereof between the outdoor heat exchanger 24 and the refrigerant cooler 35. Moreover, here, a liquid pressure adjusting expansion valve 37 for reducing the pressure of the refrigerant is located in the outdoor liquid refrigerant pipe 25 at a part thereof between the liquid refrigerant communication pipe 6 and the refrigerant cooler 35 (here, at a part thereof between the refrigerant cooler 35 and the liquid side shutoff valve 27) so that the refrigerant flows through the liquid refrigerant communication pipe 6 in a gas-liquid two-phase state and so that the refrigerant flows through the outlet of the refrigerant cooler 35 in a liquid state. Here, the liquid pressure adjusting expansion valve 37 is comprised of an electric expansion valve.

The refrigerant returning pipe 31 is a refrigerant pipe for sending the refrigerant branched off from the outdoor liquid refrigerant pipe 25 to the suction side of the compressor 21. The refrigerant returning pipe 31 mainly includes a refrigerant returning inlet pipe 32 and a refrigerant returning outlet pipe 33. The refrigerant returning inlet pipe 32 is a refrigerant pipe for branching a portion of the refrigerant flowing through the outdoor liquid refrigerant pipe 25 off from a part between the liquid-side end of the outdoor heat exchanger 24 and the liquid pressure adjusting expansion valve 37 (here, a part between the outdoor expansion valve 36 and the refrigerant cooler 35) and sending to the inlet of the refrigerant cooler 35 on the refrigerant returning pipe 31 side. The refrigerant returning inlet pipe 32 is provided with a refrigerant returning expansion valve 34 for adjusting the flow rate of the refrigerant flowing through the refrigerant cooler 35 while reducing the pressure of the refrigerant that flows through the refrigerant returning pipe 31 to the low pressure of the refrigeration cycle. Here, the refrigerant returning expansion valve 34 is comprised of an electric expansion valve. The refrigerant returning outlet pipe 33 is a refrigerant pipe for sending refrigerant from the outlet of the refrigerant cooler 35 on the refrigerant returning pipe 31 side to the outdoor gas refrigerant pipe 26 connected to the suction side of the compressor 21. The refrigerant cooler 35 is configured to cool the refrigerant flowing through the outdoor liquid refrigerant pipe 25 using the refrigerant flowing through the refrigerant returning pipe 31 at the low pressure in the refrigeration cycle.

The outdoor unit 2 is provided with various types of sensors. More specifically, the outdoor unit 2 is provided with, in the vicinity of the compressor 21, a suction pressure sensor 38 for detecting a suction pressure Ps of the compressor 21, a suction temperature sensor 39 for detecting a suction temperature Ts of the compressor 21, a discharge pressure sensor 40 for detecting a discharge pressure Pd of the compressor 21, and a discharge temperature sensor 41 for detecting a discharge temperature Td of the compressor 21. In addition, a liquid-side outdoor heat exchange sensor 42 for detecting a temperature Tol of the refrigerant at the liquid-side end of the outdoor heat exchanger 24 is located in the outdoor liquid refrigerant pipe 25 at a part thereof between the outdoor heat exchanger 24 and the refrigerant cooler 35 (here, at a part thereof between the outdoor heat exchanger 24 and the outdoor expansion valve 36). Furthermore, an outside air sensor 43 for detecting a temperature Toa of the outside air suctioned into the outdoor unit 2 is located in the vicinity of the outdoor heat exchanger 24 or the outdoor fan 29. A refrigerant cooling-side sensor 44 for detecting a pressure Pol of the refrigerant in the outdoor liquid refrigerant pipe 25 at a part thereof provided with the refrigerant cooler 35 is located in the outdoor liquid refrigerant pipe 25 at a part thereof between the outdoor heat exchanger 24 and the liquid pressure adjusting expansion valve 37 (here, at a part thereof between the outdoor expansion valve 36 and the liquid pressure adjusting expansion valve 37). Furthermore, the refrigerant returning outlet pipe 33 is provided with a refrigerant returning-side sensor 45 for detecting a temperature Tor of the refrigerant flowing through the outlet of the refrigerant cooler 35 on the refrigerant returning pipe 31 side.

Figure 2:
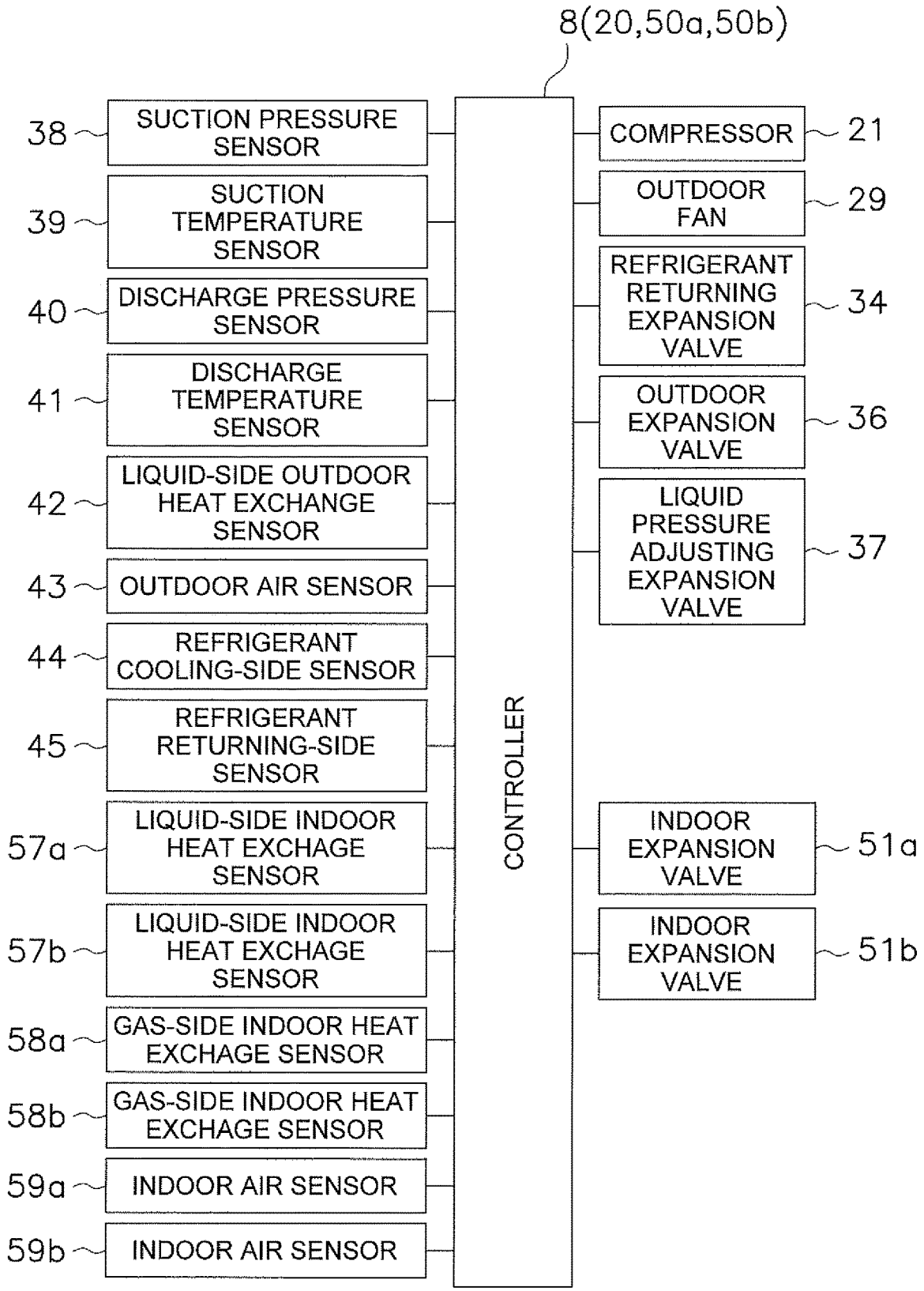
FIG. 2 is a control block diagram of the air conditioner.

The outdoor unit 2 includes an outdoor-side controller 20 for controlling the operations of each of components that constitute the outdoor unit 2. The outdoor-side controller 20 has a microcomputer, a memory, and the like provided in order to perform control of the outdoor unit 2, so that control signals and the like can be exchanged between the outdoor-side controller 20 and the indoor-side controllers 50*a* and 50*b* of the indoor units 5*a* and 5*b* via a communication line. That is, a controller 8 for performing control of the operations of the entire air conditioner 1 is configured by connecting the indoor-side controllers 50*a* and 50*b* and the outdoor-side controller 20 via the communication line. As shown in FIG. 2, the controller 8 is connected so as to be able to receive detection signals from the respective sensors 38 to 45, 57*a* to 59*a*, and 57*b* to 59*b* and is also connected so as to be able to control the respective devices 21, 29, 34, 36, 37, 51*a*, 55*a*, 51*b*, 55*b*, and the like based on these detection signals and the like. Here, FIG. 2 is a control block diagram of the air conditioner 1.

(2) Operations and Features of Air Conditioner

Figure 4:
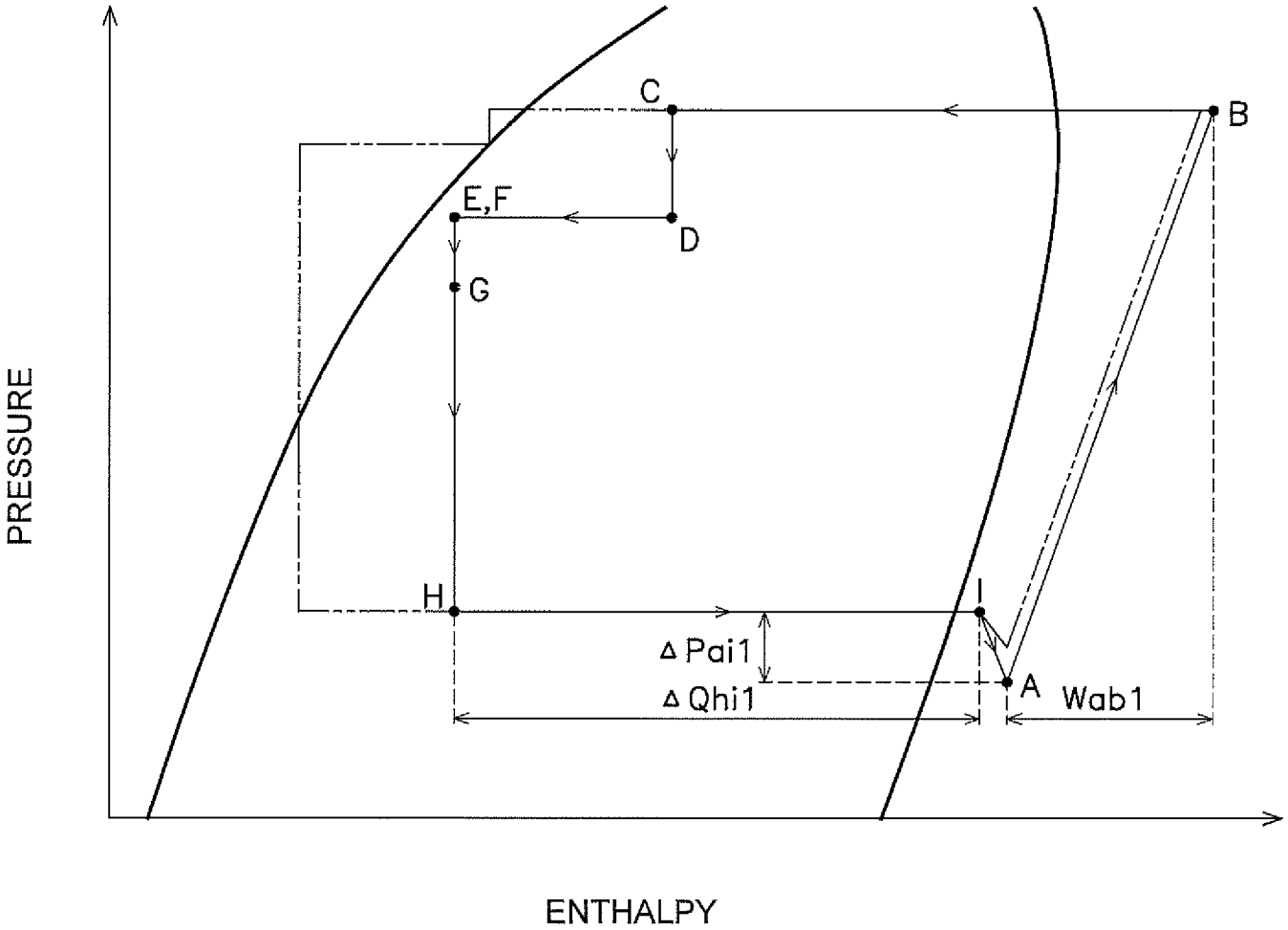
FIG. 4 is a pressure-enthalpy graph illustrating a refrigeration cycle in a case where only reduction in amount of the refrigerant to be filled is performed.
Figure 5:
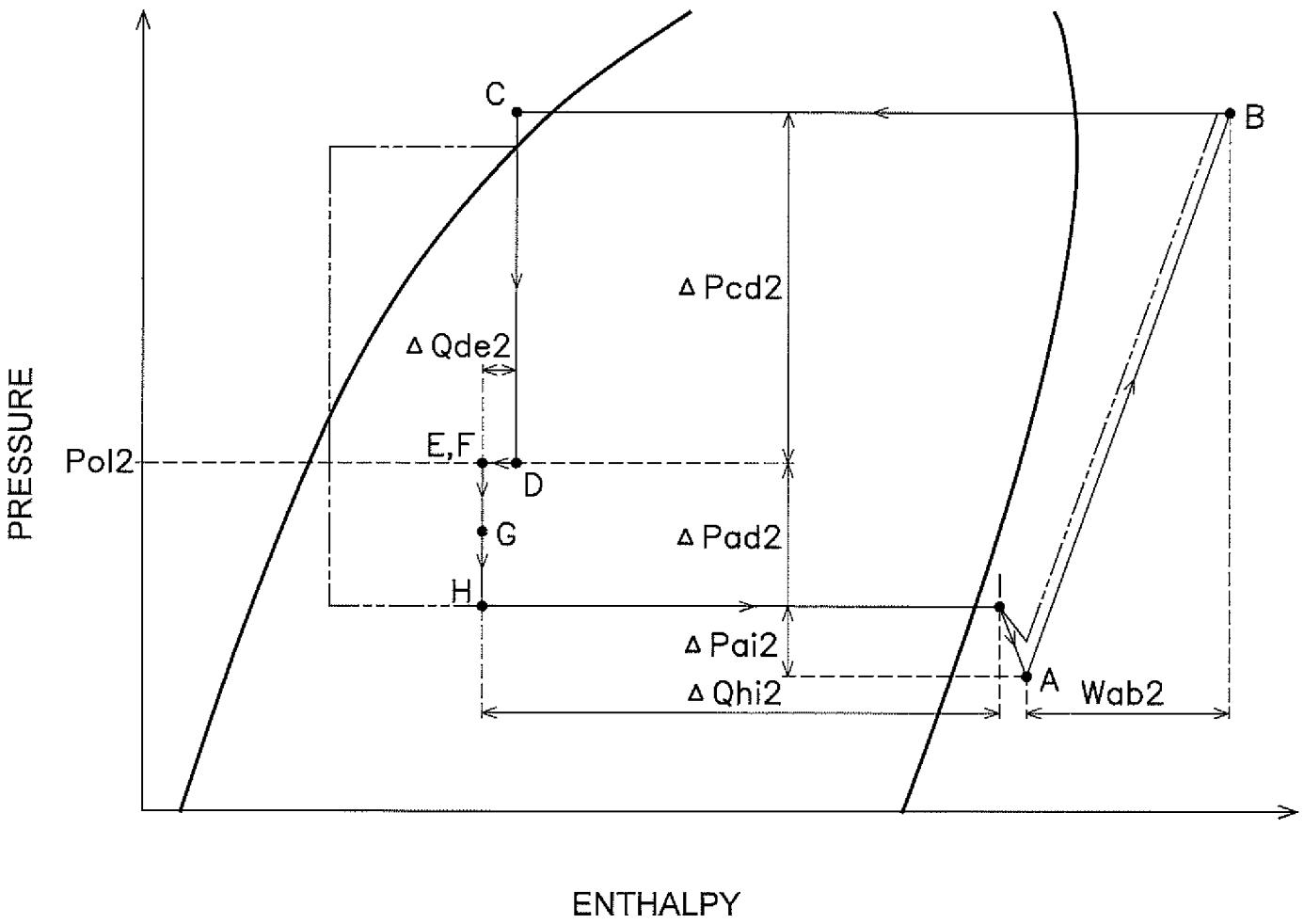
FIG. 5 is a pressure-enthalpy graph illustrating a refrigeration cycle in a case where reduction in amount of the refrigerant to be filled is performed and decrease in pressure is performed using an outdoor expansion valve until the refrigerant flows in a gas-liquid two-phase state.

Next, the operations and features of the air conditioner 1 will be described with reference to FIGS. 1 to 5. Here, FIG. 3 is a pressure-enthalpy graph illustrating a refrigeration cycle during a cooling operation, FIG. 4 is a pressure-enthalpy graph illustrating a refrigeration cycle in a case where only reduction in amount of the refrigerant to be filled is performed, and FIG. 5 is a pressure-enthalpy graph illustrating the refrigeration cycle in a case where reduction in amount of the refrigerant to be filled is performed and decrease in pressure is performed using the outdoor expansion valve 36 until the refrigerant flows in a gas-liquid two-phase state.

<Operations>

The air conditioner 1 mainly performs a cooling operation in which the refrigerant filled into the refrigerant circuit 10 is circulated through in the sequence of the compressor 21, the outdoor heat exchanger 24, the liquid refrigerant communication pipe 6, the indoor expansion valves 51*a* and 51*b*, the indoor heat exchangers 52*a* and 52*b*, the gas refrigerant communication pipe 7, and the compressor 21. In addition, in the cooling operation, an operation of cooling the refrigerant flowing through the outdoor liquid refrigerant pipe 25 is also performed using the refrigerant cooler 35 located in the outdoor liquid refrigerant pipe 25 as well as the refrigerant returning pipe 31 connected to the outdoor liquid refrigerant pipe 25 that connects the liquid-side end of the outdoor heat exchanger 24 and the liquid refrigerant communication pipe 6. Furthermore, in the cooling operation, an operation of reducing the pressure of the refrigerant is also performed using the liquid pressure adjusting expansion valve 37 located in the outdoor liquid refrigerant pipe 25 at a part thereof between the liquid refrigerant communication pipe 6 and the refrigerant cooler 35 so that the refrigerant flows through the liquid refrigerant communication pipe 6 in a gas-liquid two-phase state and so that the refrigerant flows through the outlet of the refrigerant cooler 35 in a liquid state. Note that the operations of the air conditioner 1 described below are performed by the controller 8 that controls the constituent components of the air conditioner 1.

Figure 3:
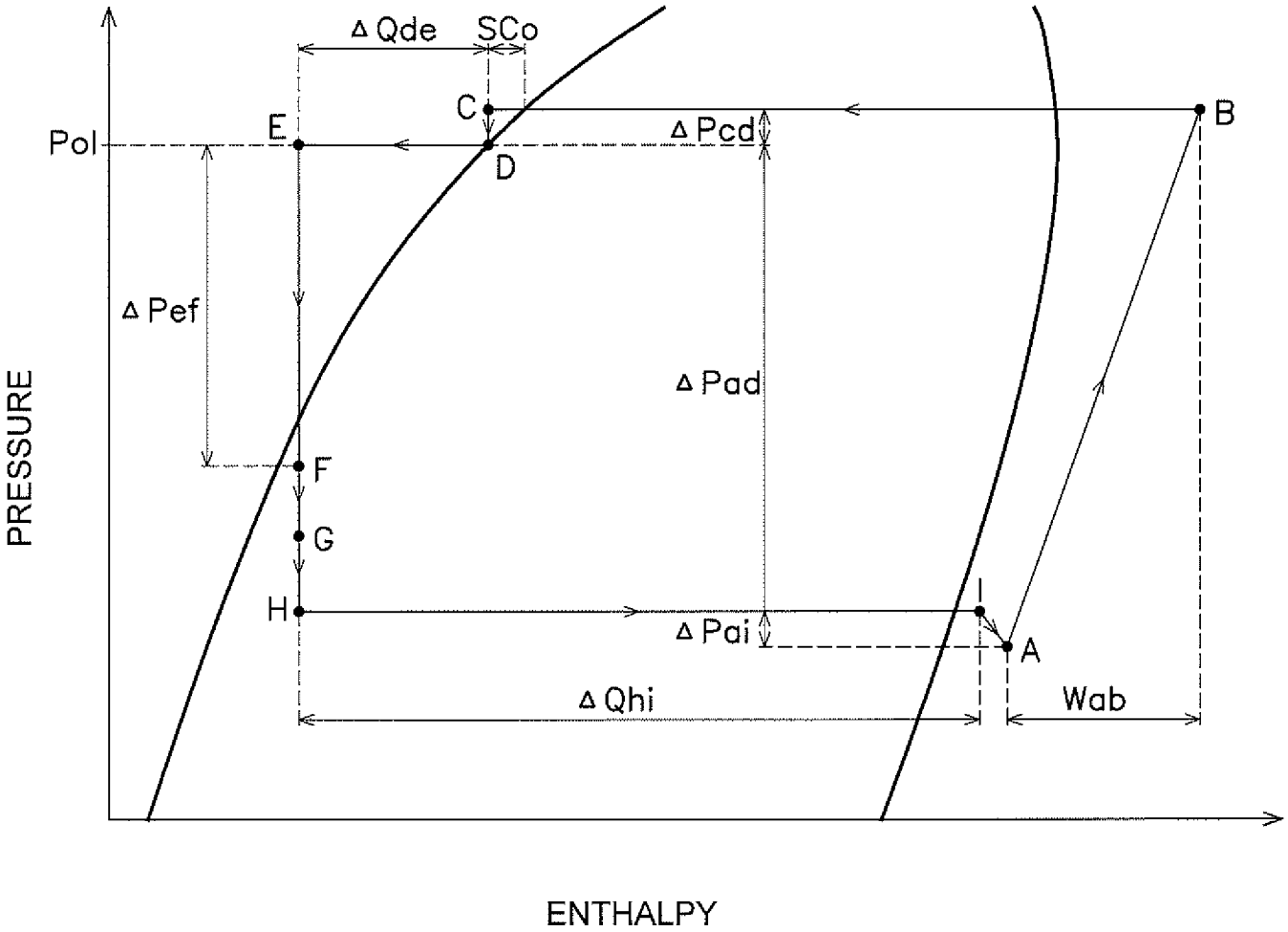
FIG. 3 is a pressure-enthalpy graph illustrating a refrigeration cycle during the cooling operation.

The refrigerant filled into the refrigerant circuit 10 is first suctioned into the compressor 21 and compressed to increase the pressure from low to high in the refrigerant cycle, to be discharged therefrom (see the points A and B in FIGS. 1 and 3). The refrigerant discharged in a gas state from the compressor 21 flows into the gas-side end of the outdoor heat exchanger 24.

The refrigerant flowing into the gas-side end of the outdoor heat exchanger 24 becomes a refrigerant in a liquid state in the outdoor heat exchanger 24 by releasing its heat through heat exchange with the outside air supplied through the outdoor fan 29, and flows out from the liquid-side end of the outdoor heat exchanger 24 (see the point C in FIGS. 1 and 3).

The refrigerant flowing out from the liquid-side end of the outdoor heat exchanger 24 flows through the outdoor liquid refrigerant pipe 25 and is reduced in pressure by the outdoor expansion valve 36 (see the point D in FIGS. 1 and 3). The refrigerant reduced in pressure by the outdoor expansion valve 36 flows into the inlet of the refrigerant cooler 35 on the outdoor liquid refrigerant pipe 25 side. Here, the controller 8 controls an opening degree MVoo of the outdoor expansion valve 36 such that a subcooling degree SCo of the refrigerant at the liquid-side end of the outdoor heat exchanger 24 reaches a target subcooling degree SCot. The controller 8 obtains the subcooling degree SCo of the refrigerant at the liquid-side end of the outdoor heat exchanger 24 from the temperature Tol of the refrigerant detected by the liquid-side outdoor heat exchange sensor 42. More specifically, the controller 8 obtains the subcooling degree SCo of the refrigerant by subtracting the temperature Tol of the refrigerant from a temperature Toc of the refrigerant that is obtained by converting a discharge pressure Pd detected by the discharge pressure sensor 40 to a saturation temperature. The target subcooling degree SCot is set to be as small as possible (for example, 1 to 3° C.) so that it is easy to maintain the refrigerant, which flows through the outdoor liquid refrigerant pipe 25 after being reduced in pressure by the outdoor expansion valve 36, in a state of having a high level of wetness (see the point D in FIGS. 1 and 3). Then, the controller 8 performs control to increase the opening degree MVoo of the outdoor expansion valve 36 when the subcooling degree SCo is larger than the target subcooling degree Scot, and performs control to decrease the opening degree MVoo of the outdoor expansion valve 36 when the subcooling degree SCo is smaller than the target subcooling degree SCot.

The refrigerant flowing into the inlet of the refrigerant cooler 35 on the outdoor liquid refrigerant pipe 25 side becomes a refrigerant in a subcooled state (that is, a liquid state) by further being cooled through heat exchange in the refrigerant cooler 35 with the refrigerant flowing through the refrigerant returning pipe 31 (see the point E in FIGS. 1 and 3). At this point of time, a portion of the refrigerant reduced in pressure by the outdoor expansion valve 36 is branched off to the refrigerant returning pipe 31 and is reduced in pressure until it reaches a pressure close to the low pressure in the refrigerant cycle by the refrigerant returning expansion valve 34. The refrigerant flowing through the refrigerant returning pipe 31 after being reduced in pressure by the refrigerant returning expansion valve 34 flows into the inlet of the refrigerant cooler 35 on the refrigerant returning pipe 31 side. The refrigerant flowing into the inlet of the refrigerant cooler 35 on the refrigerant returning pipe 31 side becomes a refrigerant in a gas state by being heated through heat exchange in the refrigerant cooler 35 with the refrigerant flowing through the outdoor liquid refrigerant pipe 25. Then, the refrigerant cooled in the refrigerant cooler 35 flows out from the outlet of the refrigerant cooler 35 on the outdoor liquid refrigerant pipe 25 side and is sent to the liquid pressure adjusting expansion valve 37. The refrigerant heated in the refrigerant cooler 35 flows out from the outlet of the refrigerant cooler 35 on the refrigerant returning pipe 31 side and is returned to the suction side of the compressor 21 (here, the outdoor gas refrigerant pipe 26). Here, the controller 8 controls an opening degree MVor of the refrigerant returning expansion valve 34 so that a superheating degree SHo of the refrigerant at the outlet of the refrigerant cooler 35 on the refrigerant returning pipe 31 side reaches a target superheating degree SHot. The controller 8 obtains the superheating degree SHo of the refrigerant at the outlet of the refrigerant cooler 35 on the refrigerant returning pipe 31 side by subtracting a temperature Tos of the refrigerant obtained by converting the suction pressure Ps detected by the suction pressure sensor 38 to the saturation temperature from the temperature Tor of the refrigerant detected by the refrigerant returning-side sensor 45. The target superheating degree SHot is set to a value of about 3 to 10° C. so that the refrigerant suctioned into the compressor 21 (see the point A in FIGS. 1 and 3) does not enter a state that has a high level of wetness. Then, the controller 8 performs control to increase the opening degree MVor of the refrigerant returning expansion valve 34 when the superheating degree SHo is larger than the target superheating degree SHot, and performs control to decrease the opening degree MVor of the refrigerant returning expansion valve 34 when the superheating degree SHo is smaller than the target superheating degree SHot.

The refrigerant sent to the liquid pressure adjusting expansion valve 37 is reduced in pressure by the liquid pressure adjusting expansion valve 37 so that the refrigerant flows through the liquid refrigerant communication pipe 6 in a gas-liquid two-phase state and so that the refrigerant flows through the outlet of the refrigerant cooler 35 in a liquid state (see the points E and F in FIGS. 1 and 3). Here, the controller 8 controls an opening degree MVop of the liquid pressure adjusting expansion valve 37 such that the pressure Pol of the refrigerant in the outdoor liquid refrigerant pipe 25 at a part thereof provided with the refrigerant cooler 35 reaches a target liquid pressure Polt. The controller 8 obtains the pressure Pol of the refrigerant in the outdoor liquid refrigerant pipe 25 at a part thereof provided with the refrigerant cooler 35 from the pressure of the refrigerant detected by the refrigerant cooling-side sensor 44. The target liquid pressure Polt is set to be as high as possible so that the refrigerant flows through the outlet of the refrigerant cooler 35 in a liquid state. Then, the controller 8 performs control to increase the opening degree MVop of the liquid pressure adjusting expansion valve 37 when the pressure Pol of the refrigerant is higher than the target liquid pressure Polt, and performs control to decrease the opening degree MVop of the liquid pressure adjusting expansion valve 37 when the pressure Pol of the refrigerant is lower than the target liquid pressure Polt.

The refrigerant reduced in pressure by the liquid pressure adjusting expansion valve 37 is sent to the liquid refrigerant communication pipe 6 via the liquid side shutoff valve 27. At this point of time, because the refrigerant flowing through the liquid refrigerant communication pipe 6 is in a gas-liquid two-phase state, as compared to a case where the refrigerant flowing through the liquid refrigerant communication pipe 6 is in a liquid state (that is, a case where the configuration of PTL 3 is employed), the liquid refrigerant communication pipe 6 is filled with a reduced amount of a refrigerant in a liquid state, and thereby the amount of the refrigerant in the liquid refrigerant communication pipe 6 can be reduced by the reduced amount. The refrigerant sent to the liquid refrigerant communication pipe 6 is sent to the indoor units 5*a* and 5*b* after being reduced in pressure due to a loss in pressure that is caused corresponding to the length and diameter of the pipe (see the point G in FIGS. 1 and 3).

The refrigerant sent to the indoor units 5*a* and 5*b* is reduced in pressure until it reaches a pressure close to the low pressure of the refrigerant cycle by the indoor expansion valves 51*a* and 51*b* (see the point H in FIGS. 1 and 3). The refrigerant after being reduced in pressure by the indoor expansion valves 51*a* and 51*b* flows into the liquid-side ends of the indoor heat exchangers 52*a* and 52*b*. The refrigerant flowing into the liquid-side ends of the indoor heat exchangers 52*a* and 52*b* becomes a refrigerant in a gas state by being evaporated through heat exchange in the indoor heat exchangers 52*a* and 52*b* with the indoor air supplied by the indoor fans 55*a* and 55*b*, and flows out from the gas-side ends of the indoor heat exchangers 52*a* and 52*b* (see the point I in FIGS. 1 and 3). Further, the indoor air cooled through heat exchange with the refrigerant in the indoor heat exchangers 52*a* and 52*b* is supplied to indoors thereby perform cooling of the indoors. Here, the controller 8 controls an opening degree MVrr of the indoor expansion valves 51*a* and 51*b* such that superheating degree SHr of the refrigerant at the gas-side ends of the indoor heat exchangers 52*a* and 52*b* reaches a target superheating degree SHrt. The controller 8 obtains the superheating degrees SHr of the refrigerant at the gas-side ends of the indoor heat exchangers 52*a* and 52*b* by subtracting the temperatures Trl of the refrigerant detected by the liquid-side indoor heat exchange sensors 57*a* and 57*b* from the temperatures Trg of the refrigerant detected by the gas-side indoor heat exchange sensors 58*a* and 58*b* respectively. The target superheating degree SHrt is set to a value of about 3 to 10° C. so that the refrigerant suctioned into the compressor 21 (see the point A in FIGS. 1 and 3) does not enter a state that has a high level of wetness. Then, the controller 8 performs control to increase the opening degrees MVrr of the indoor expansion valves 51*a* and 51*b* when the superheating degree SHr is larger than the target superheating degree SHrt, and performs control to decrease the opening degrees MVrr of the indoor expansion valves 51*a* and 51*b* when the superheating degree SHr is smaller than the target superheating degree SHrt.

The refrigerant flowing out from the gas-side ends of the indoor heat exchangers 52*a* and 52*b* is sent to the gas refrigerant communication pipe 7. The refrigerant sent to the gas refrigerant communication pipe 7 is then sent to the outdoor unit 2 after being reduced in pressure due to the loss in pressure that is caused corresponding to the length and diameter of the pipe, and is suctioned again into the compressor 21 along with the refrigerant from the refrigerant returning pipe 31 via the gas side shutoff valve 28 and the outdoor gas refrigerant pipe 26 (see the point A in FIGS. 1 and 3).

In this manner, a cooling operation is performed in the air conditioner 1.

<Features>

Here, as described above, in a configuration including the refrigerant circuit 10 configured by connecting, via the liquid refrigerant communication pipe 6 and the gas refrigerant communication pipe 7, the outdoor unit 2 having the compressor 21 and the outdoor heat exchanger 24, and the plurality of indoor units 5*a* and 5*b* having the indoor expansion valves 51*a* and 51*b* and the indoor heat exchangers 52*a* and 52*b*, first, the refrigerant returning pipe 31 and the refrigerant cooler 35 are located in the outdoor liquid refrigerant pipe 25 that connects the liquid-side end of the outdoor heat exchanger 24 and the liquid refrigerant communication pipe 6. Here, the refrigerant returning pipe 31 is a refrigerant pipe for sending the refrigerant branched off from the outdoor liquid refrigerant pipe 25 to the suction side of the compressor 21, which thereby provides the refrigerant cooler 35 with a cooling function that is obtained by utilizing a difference in pressure between the pressure of the refrigerant flowing through the outdoor liquid refrigerant pipe 25 and the low pressure of the refrigeration cycle. Furthermore, by providing the liquid pressure adjusting expansion valve 37 in the outdoor liquid refrigerant pipe 25 at a part thereof between the liquid refrigerant communication pipe 6 and the refrigerant cooler 35 as described above, the refrigerant flowing through the outdoor liquid refrigerant pipe 25 is reduced in pressure (see ΔPef in FIG. 3) so that the refrigerant flows through the liquid refrigerant communication pipe 6 in a gas-liquid two-phase state (see the points F and G in FIG. 3) and so that the refrigerant flows through the outlet of the refrigerant cooler 35 in a liquid state (see the point E in FIG. 3).

For these reasons, here, the pressure of the refrigerant flowing through the refrigerant cooler 35 is unlikely to fall, and the refrigerant can flow through the refrigerant cooler 35 with a high level of wetness, and also a difference in pressure (see ΔPad in FIG. 3) can be easily secured between the refrigerant flowing through the outdoor liquid refrigerant pipe 25 and the refrigerant flowing through the refrigerant returning pipe 31, and therefore, a cooling function (see ΔQde in FIG. 3) can be adequately fulfilled in the refrigerant cooler 35. As a result, the flow rate of the refrigerant sent to the plurality of indoor units 5*a* and 5*b* can be reduced, and the loss in pressure (refer to ΔPai in FIG. 3) in the gas refrigerant communication pipe 7 and the like can be decreased, and therefore, improving the refrigeration capacity (see ΔQhi in FIG. 3) and operating efficiency (the value obtained by dividing ΔQhi by Wab in FIG. 3).

In this manner, here, in the air conditioner 1 including the refrigerant circuit 10 configured by connecting, via the liquid refrigerant communication pipe 6 and the gas refrigerant communication pipe 7, the outdoor unit 2 having the compressor 21 and the outdoor heat exchanger 24, and the plurality of indoor units 5*a* and 5*b* having the indoor expansion valves 51*a* and 51*b* and the indoor heat exchangers 52*a* and 52*b*, the amount of the refrigerant to be filled into the refrigerant circuit 10 can be reduced while the refrigeration capacity and operating efficiency using the refrigerant returning pipe 31 and the refrigerant cooler 35 are improved.

Moreover, here, the controller 8 controls the opening degree MVop of the liquid pressure adjusting expansion valve 37 such that the pressure Pol of the refrigerant in the outdoor liquid refrigerant pipe 25 at a part thereof provided with the refrigerant cooler 35 reaches the target liquid pressure Polt, in order to achieve the operation of reducing pressure in the outdoor liquid refrigerant pipe 25 as described above.

For this reason, here, the pressure Pol of the refrigerant flowing through the refrigerant cooler 35 can be maintained to be high, which enables the refrigerant with a high level of wetness to reliably flow through the refrigerant cooler 35. Note that it is possible to accurately obtain the pressure Pol of the refrigerant in the outdoor liquid refrigerant pipe 25 at a part thereof provided with the refrigerant cooler 35 using the refrigerant cooling-side sensor 44 provided in the outdoor liquid refrigerant pipe 25 at a part thereof between the outdoor heat exchanger 24 and the refrigerant cooler 35 (here, a part between the outdoor expansion valve 36 and the liquid pressure adjusting expansion valve 37), and therefore, the liquid pressure adjusting expansion valve 37 can be controlled in a precise manner.

In addition, here, by providing the outdoor expansion valve 36 in the outdoor liquid refrigerant pipe 25 at a part thereof between the outdoor heat exchanger 24 and the refrigerant cooler 35, the opening degree MVoo of the outdoor expansion valve 36 is controlled such that the subcooling degree SCo of the refrigerant at the liquid-side end of the outdoor heat exchanger 24 (see the point C in FIG. 3) reaches the target subcooling degree SCot. For this reason, the pressure Pol of the refrigerant in the outdoor liquid refrigerant pipe 25 is likely to fall at the part provided with the refrigerant cooler 35 (see ΔPcd in FIG. 3). In contrast to this, here, the opening degree MVop of the liquid pressure adjusting expansion valve 37 is controlled such that the pressure Pol of the refrigerant in the outdoor liquid refrigerant pipe 25 at a part thereof provided with the refrigerant cooler 35 reaches the target liquid pressure Polt as described above.

For this reason, here, although the outdoor expansion valve 36 reduces the pressure of the refrigerant flowing through the outdoor liquid refrigerant pipe 25 at a part thereof between the outdoor heat exchanger 24 and the refrigerant cooler 35, the pressure Pol of the refrigerant flowing through the refrigerant cooler 35 can be maintained to be high, which enables the refrigerant with a high level of wetness to reliably flow through the refrigerant cooler 35. Note that it is possible to correctly obtain the subcooling degree SCo of the refrigerant at the liquid-side end of the outdoor heat exchanger 24 using the liquid-side outdoor heat exchange sensor 42 located in the outdoor liquid refrigerant pipe 25 at a part thereof between the outdoor heat exchanger 24 and the outdoor expansion valve 36, and therefore, the outdoor expansion valve 36 can be controlled in a precise manner.

In contrast to this, a case is assumed where, in a configuration having the refrigerant returning pipe 31 and the refrigerant cooler 35, an amount of the refrigerant to be filled is reduced without the liquid pressure adjusting expansion valve 37 in the outdoor liquid refrigerant pipe 25 at a part thereof between the liquid refrigerant communication pipe 6 and the refrigerant cooler 35. That is, a case is assumed where only reduction in amount of the refrigerant to be filled is performed in the same configuration as PTL 3. In this case, unlike the refrigeration cycle illustrated by the two-dot chain line (that is, the refrigeration cycle of FIG. 3), as shown in FIG. 4, due to the less amount of the refrigerant to be filled, a refrigerant in a gas-liquid two-phase state is apt to flow out from the liquid-side end of the outdoor heat exchanger 24 (see the point C in FIG. 4). As a result, the refrigerant flows through the liquid refrigerant communication pipe 6 in a gas-liquid two-phase state, but the refrigeration capacity (ΔQhi 1 in FIG. 4) is decreased (ΔQhi 1<ΔQhi), which creates a necessity to increase an amount of the refrigerant circulation flow to compensate for the decreased capacity. However, when the amount of the refrigerant circulation flow is increased, the loss in pressure (see ΔPai1 in FIG. 4) in the gas refrigerant communication pipe 7 and the like is increased (ΔPai1>ΔPai). Consequently, the power consumption of the compressor 21 (Wab 1 in FIG. 4) increases (Wab 1>Wab) and also the operating efficiency (the value obtained by dividing ΔQhi1 by Wab1) falls.

To address such a changing of the refrigerant into a gas-liquid two-phase state at the liquid-side end of the outdoor heat exchanger 24 that is caused by reduction in amount of the refrigerant to be filled, the pressure in the refrigerant can be significantly reduced by the outdoor expansion valve 36 connected to the liquid-side end of the outdoor heat exchanger 24. That is, in a configuration similar to that of PTL 3, the pressure in the refrigerant can be reduced by the outdoor expansion valve 36 connected to the liquid-side end of the outdoor heat exchanger 24 such that the refrigerant flows through the liquid refrigerant communication pipe 6 in a gas-liquid two-phase state, as in PTL 1 and 2. However, in this case, unlike the refrigeration cycle illustrated by the two-dot chain line (that is, the refrigeration cycle of FIG. 3), as shown in FIG. 5, a significant reduction in pressure of the refrigerant (see ΔPcd2 in FIG. 5) is caused by the outdoor expansion valve 36 connected to the liquid-side end of the outdoor heat exchanger 24, and then a pressure Pol2 of the refrigerant flowing through the refrigerant cooler 35 falls (Pol2<Pol), which disables a flow of the refrigerant with a high level of wetness through the refrigerant cooler 35 (see the points D, E, and F in FIG. 5). In addition, it is difficult to secure a difference in pressure (see ΔPad2 in FIG. 5) between the refrigerant flowing through the outdoor liquid refrigerant pipe 25 and the refrigerant flowing through the refrigerant returning pipe 31 (ΔPad2<ΔPad), and the cooling function (ΔQde2 in FIG. 5) of the refrigerant cooler is no longer able to be adequately fulfilled (ΔQde2<ΔQde). As a result, similarly to the case where only reduction in amount of the refrigerant to be filled is performed (refer to FIG. 4), the refrigerant flows through the liquid refrigerant communication pipe 6 in a gas-liquid two-phase state, but the refrigeration capacity (ΔQhi1 in FIG. 4) is decreased (ΔQhi1<ΔQhi), which creates a necessity to increase an amount of the refrigerant circulation flow to compensate for the decreased capacity. Then, when the amount of the refrigerant circulation flow is increased, the loss in pressure (refer to ΔPai2 in FIG. 5) in the gas refrigerant communication pipe 7 and the like is increased (ΔPai2>ΔPai). For this reason, the power consumption of the compressor 21 (Wab2 in FIG. 5) increases (Wab2>Wab) and also the operating efficiency (the value obtained by dividing ΔQhi2 by Wab2) falls.

As described above, in the case (see FIG. 4) where only reduction in amount of the refrigerant to be filled is performed and the case (see FIG. 5) where reduction in pressure of the refrigerant is performed by the outdoor expansion valve 36 connected to the liquid-side end of the outdoor heat exchanger 24 so that the refrigerant flows through the liquid refrigerant communication pipe 6 in a gas-liquid two-phase state, unlike the case (see FIG. 3) where the liquid pressure adjusting expansion valve 37 is located in the outdoor liquid refrigerant pipe 25 at a part thereof between the liquid refrigerant communication pipe 6 and the refrigerant cooler 35, the amount of refrigerant to be filled into the refrigerant circuit 10 cannot be reduced while the refrigeration capacity and operating efficiency are improved using the refrigerant returning pipe 31 and the refrigerant cooler 35.

(3) Modified Examples

<A>

In the embodiment described above, in order to flow the refrigerant through the liquid refrigerant communication pipe 6 in a gas-liquid two-phase state and to flow the refrigerant through the outlet of the refrigerant cooler 35 in a liquid state, the opening degree MVoo of the outdoor expansion valve 36 is controlled such that the subcooling degree SCo of the refrigerant at the liquid-side end of the outdoor heat exchanger 24 reaches the target subcooling degree SCot, and the opening degree MVop of the liquid pressure adjusting, expansion valve 37 is controlled such that the pressure Pol of the refrigerant in the outdoor liquid refrigerant pipe 25 at a part thereof provided with the refrigerant cooler 35 reaches the target liquid pressure Polt.

However, the controls of the two expansion valves 36 and 37 are likely to affect each other, and this tends to make the opening degrees MVoo and MVop of both of the expansion valves 36 and 37 unstable. For example, in a state where the outdoor expansion valve 36 and the liquid pressure adjusting expansion valve 37 are stabilized at certain opening degrees (that is, a state of being stabilized at the target subcooling degree SCot and at the target liquid pressure Polt), when the opening degree MVoo of the outdoor expansion valve 36 is controlled to be increased, the pressure Pol of the refrigerant on the downstream side of the outdoor expansion valve 36 (that is, in the outdoor liquid refrigerant pipe 25 at a part thereof between the outdoor expansion valve 36 and the liquid pressure adjusting expansion valve 37) is changed for increasing. The change in pressure of the refrigerant caused by the change in the opening degree MVoo of the outdoor expansion valve 36 occurs considerably suddenly, and therefore, swift control of the opening degree MVop of the liquid pressure adjusting expansion valve 37 is required, but if the control sensitivity is excessively raised, the stability is impaired. As a result, the opening degree MVop of the liquid pressure adjusting expansion valve 37 and furthermore the opening degrees MVoo and MVop of both of the expansion valves 36 and 37 are likely to be unstable.

Therefore, here, in controlling the liquid pressure adjusting expansion valve 37, the changeable range of opening degrees is restricted to the lower limit opening degree MVopm or higher, and the lower limit opening degree MVopm is revised according to the opening degree MVoo of the outdoor expansion valve 36, so as not to excessively raise the control sensitivity, but to swiftly follow the change in pressure of the refrigerant on the downstream side of the outdoor expansion valve 36 (that is, in the outdoor liquid refrigerant pipe 25 at a part thereof between the outdoor expansion valve 36 and the liquid pressure adjusting expansion valve 37) caused by controlling the opening degree of the outdoor expansion valve 36. Here, to revise the lower limit opening degree MVopm of the liquid pressure adjusting expansion valve 37, a function is set such that the lower limit opening degree MVopm of the liquid pressure adjusting expansion valve 37 increases as the opening degree MVoo of the outdoor expansion valve 36 increases, and thereby it is possible to revise the lower limit opening degree MVopm according to the function.

As a result, here, although the controlling of the opening degree of the outdoor expansion valve 36 and the controlling of the opening degree of the liquid pressure adjusting expansion valve 37 are likely to affect each other, both of the expansion valves 36 and 37 can be controlled with good stability and follow-up performance.

<B>

In the embodiment and Modified Example A described above, controlling of the opening degree of the liquid pressure adjusting expansion valve 37 is performed by obtaining the pressure Pol of the refrigerant in the outdoor liquid refrigerant pipe 25 at a part thereof provided with the refrigerant cooler 35 from the pressure value of the refrigerant detected by the refrigerant cooling-side sensor 44 located in the outdoor liquid refrigerant pipe 25 at a part thereof between the outdoor expansion valve 36 and the liquid pressure adjusting expansion valve 37, as shown in FIG. 1.

Figure 6:
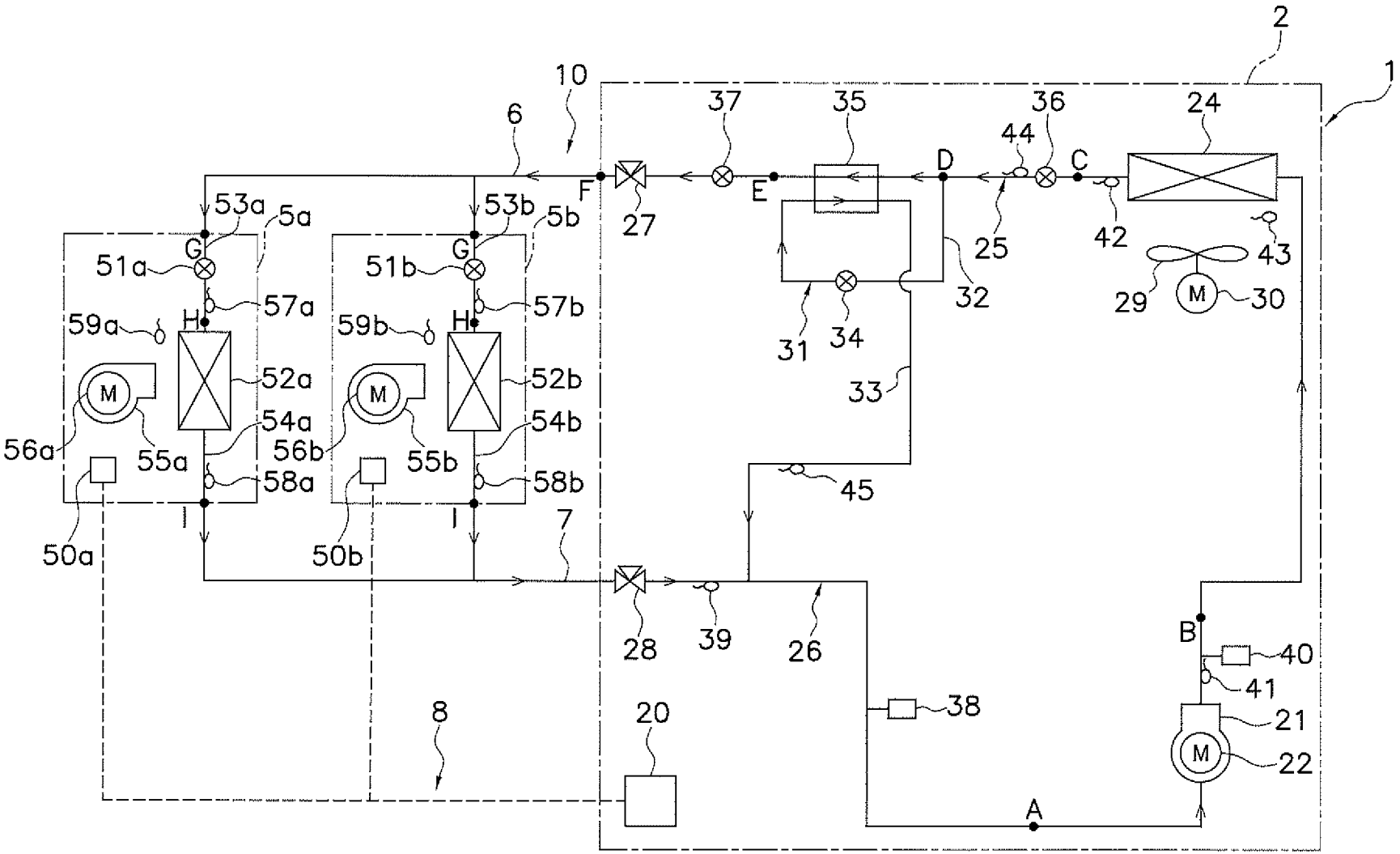
FIG. 6 is a schematic configuration diagram of an air conditioner according to Modified Example B (with illustration of the flow of refrigerant during a cooling operation).

However, the pressure Pol of the refrigerant need not be obtained from the pressure of the refrigerant detected by the refrigerant cooling-side sensor 44 that is comprised of a pressure sensor, but may be obtained from a state quantity equivalent to the pressure of the refrigerant. For example, the refrigerant at the liquid-side end of the outdoor heat exchanger 24 including the downstream side of the outdoor expansion valve 36 is almost in the state of a saturation liquid (see the points C and D in FIG. 3), and therefore, as shown in FIG. 6, the pressure Pol of the refrigerant in the outdoor liquid refrigerant pipe 25 at a part thereof provided with the refrigerant cooler 35 may be obtained by providing the refrigerant cooling-side sensor 44 comprised of a temperature sensor in the outdoor liquid refrigerant pipe 25 at a part thereof between the outdoor heat exchanger 24 side and the liquid pressure adjusting expansion valve 37 and by converting a temperature value for the refrigerant detected by the refrigerant cooling-side sensor 44 into a saturation pressure.

<C>

In the embodiment and Modified Examples A and B described above, in order to flow the refrigerant through the liquid refrigerant communication pipe 6 in a gas-liquid two-phase state and in order to flow the refrigerant through the outlet of the refrigerant cooler 35 in a liquid state, the opening degree MVoo of the outdoor expansion valve 36 is controlled such that the subcooling degree SCo of the refrigerant at the liquid-side end of the outdoor heat exchanger 24 reaches the target subcooling degree SCot, and the opening degree MVop of the liquid pressure adjusting expansion valve 37 is controlled such that the pressure Pol of the refrigerant in the outdoor liquid refrigerant pipe 25 at a part thereof provided with the refrigerant cooler 35 reaches the target liquid pressure Polt.

However, the control to achieve the refrigerant that flows through the liquid refrigerant communication pipe 6 in a gas-liquid two-phase state and the refrigerant that flows through the outlet of the refrigerant cooler 35 in a liquid state is not limited to the one described above, and other control may be used. For example, although in the embodiment and Modified Examples A and B described above, the opening degree of the outdoor expansion valve 36 is controlled such that the subcooling degree SCo of the refrigerant at the liquid-side end of the outdoor heat exchanger 24 reaches the target subcooling degree SCot, the outdoor expansion valve 36 may be fully opened and then the controller 8 may control the opening degree MVop of the liquid pressure adjusting expansion valve 37 such that the subcooling degree SCo of the refrigerant reaches the target subcooling degree SCot. Note that the outdoor expansion valve 36 is fully open in the above control, but the control is not limited thereto, and the outdoor expansion valve 36 may be omitted.

In this case, the opening degree of the liquid pressure adjusting expansion valve 37 is controlled to make the subcooling degree SCo of the refrigerant reach the target subcooling degree SCot, which facilitates the maintenance of the refrigerant in a liquid state that flows in the outdoor liquid refrigerant pipe 25 at a part thereof between the outdoor heat exchanger 24 and the liquid pressure adjusting expansion valve 37. As a result, as in the embodiment and Modified Examples A and B described above, the pressure of the refrigerant flowing through the refrigerant cooler 35 is unlikely to drop, and this enables to flow the refrigerant with a high level of wetness through the refrigerant cooler 35, and makes it easy to secure a difference in pressure (see ΔPad in FIG. 3) between the refrigerant flowing through the outdoor liquid refrigerant pipe 25 and the refrigerant flowing through the refrigerant returning pipe 31, and therefore, the cooling function (see ΔQde in FIG. 3) can be adequately fulfilled in the refrigerant cooler 35. Consequently, the flow rate of refrigerant sent to the plurality of indoor units 5*a* and 5*b* can be reduced, and the loss in pressure in the gas refrigerant communication pipe 7 and the like (see ΔPai in FIG. 3) can be decreased, which improves the refrigeration capacity (see ΔQhi in FIG. 3) and operating efficiency (the value obtained by dividing ΔQhi by Wab in FIG. 3).

In this manner, even with the control configuration of this Modified Example, in the air conditioner 1 including the refrigerant circuit 10 configured by connecting, via the liquid refrigerant communication pipe 6 and the gas refrigerant communication pipe 7, the outdoor unit 2 having the compressor 21 and the outdoor heat exchanger 24, and the plurality of indoor units 5*a* and 5*b* having the indoor expansion valves 51*a* and 51*b* and the indoor heat exchangers 52*a* and 52*b*, reduction in the amount of the refrigerant to be filled into the refrigerant circuit 10 can be achieved while the refrigeration capacity and operating efficiency are improved using the refrigerant returning pipe 31 and the refrigerant cooler 35.

<D>

In the embodiment and Modified Examples A to C described above, the refrigerant returning pipe 31 is used as a refrigerant pipe for sending the refrigerant branched off from the outdoor liquid refrigerant pipe 25 to the suction side of the compressor 21, and a difference in pressure between the pressure of the refrigerant flowing through the outdoor liquid refrigerant pipe 25 and the low pressure of the refrigeration cycle is utilized to obtain the cooling function in the refrigerant cooler 35.

Figure 7:
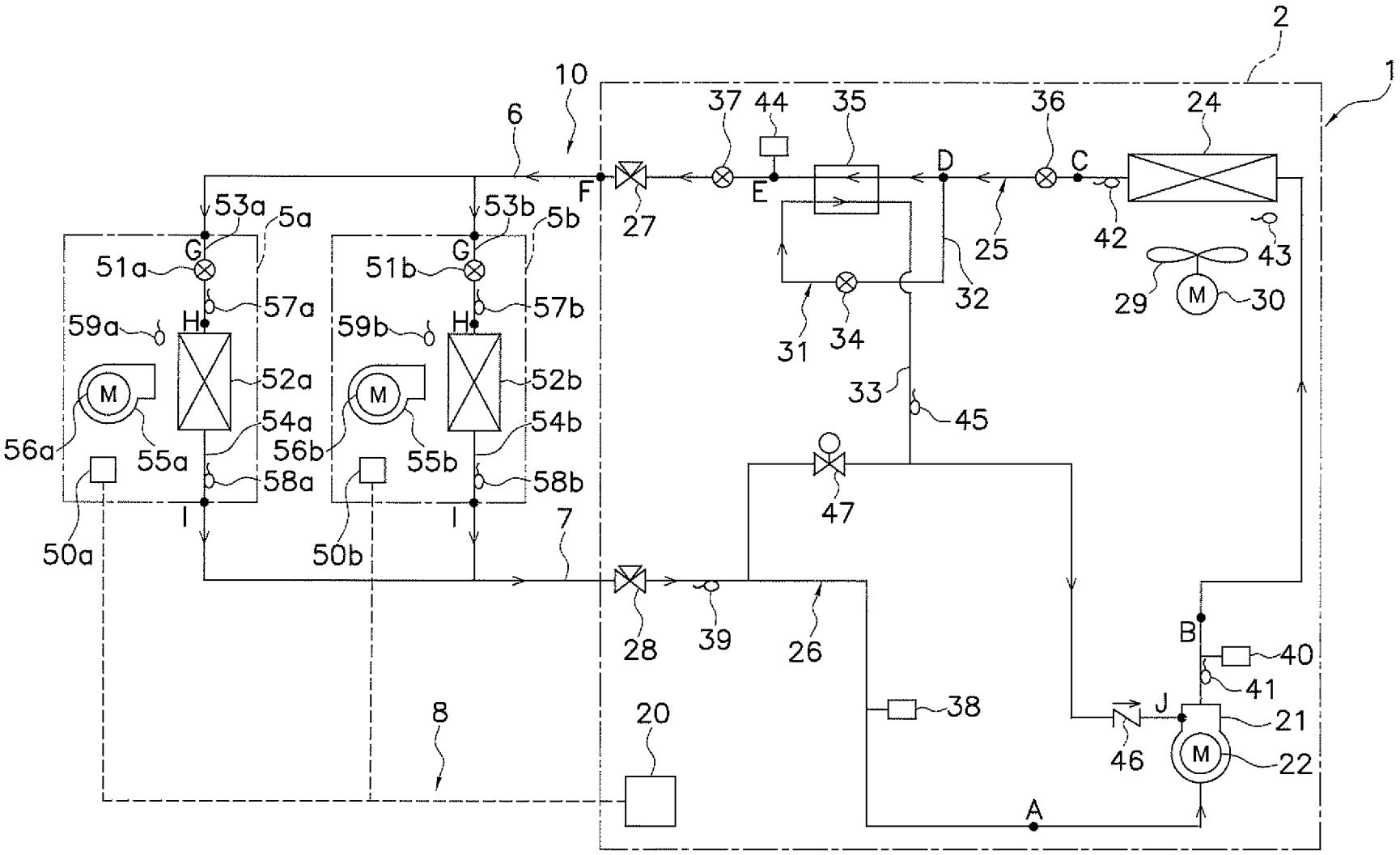
FIG. 7 is a schematic configuration diagram of an air conditioner according to Modified Example D (with illustration of the flow of refrigerant during a cooling operation).

However, the refrigerant returning pipe 31 is not limited thereto, and for example, as shown in FIG. 7, the refrigerant returning pipe 31 may be a refrigerant pipe for sending the refrigerant branched off from the outdoor liquid refrigerant pipe 25 into the middle of the compression process in the compressor 21, and a difference in pressure between the pressure of the refrigerant flowing through the outdoor liquid refrigerant pipe 25 and an intermediate pressure of the refrigeration cycle may be utilized, to obtain the cooling function in the refrigerant cooler 35. Note that in order to switch the refrigerant returning pipe 31 so as to make it function also as the refrigerant pipe for sending the refrigerant branched off from the outdoor liquid refrigerant pipe 25 to the suction side of the compressor 21, the refrigerant returning outlet pipe 33 of the refrigerant returning pipe 31 is configured to branch into two, whereby one branched pipe is connected into the middle of the compression process in the compressor 21 via a check valve 46, and the other branched pipe is connected to the suction side of the compressor 21 via a solenoid valve 47.

Figure 8:
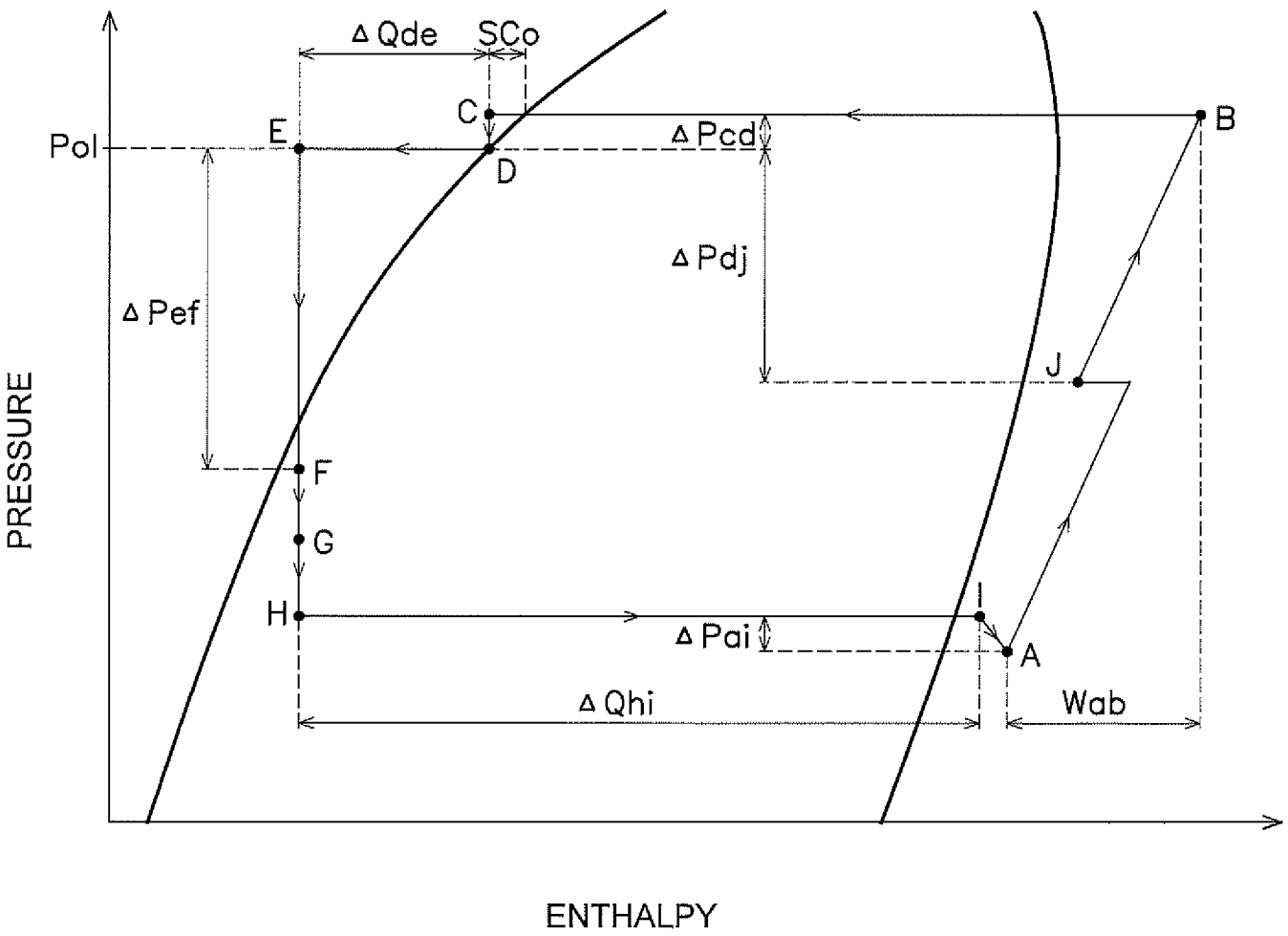
FIG. 8 is a pressure-enthalpy graph illustrating a refrigeration cycle during the cooling operation according to Modified Example D.

In this case, unlike the embodiment and Modified Examples A to C described above, a portion of the refrigerant reduced in pressure by the outdoor expansion valve 36 and branched off by the refrigerant returning pipe 31 is reduced in pressure until it reaches a pressure close to the intermediate pressure of the refrigeration cycle by the refrigerant returning expansion valve 34. The refrigerant flowing through the refrigerant returning pipe 31 after being reduced in pressure by the refrigerant returning expansion valve 34 flows into the inlet of the refrigerant cooler 35 on the refrigerant returning pipe 31 side. The refrigerant flowing into the inlet of the refrigerant cooler 35 on the refrigerant returning pipe 31 side becomes a refrigerant in a gas state by being heated through heat exchange in the refrigerant cooler 35 with the refrigerant flowing through the outdoor liquid refrigerant pipe 25, flows out from the outlet of the refrigerant cooler 35 on the refrigerant returning pipe 31 side, and is returned into the middle of the compression process in the compressor 21. However, even in this case, as shown in FIG. 8, by providing the liquid pressure adjusting expansion valve 37 in the outdoor liquid refrigerant pipe 25 at a part thereof between the liquid refrigerant communication pipe 6 and the refrigerant cooler 35, the refrigerant flowing through the outdoor liquid refrigerant pipe 25 is reduced in pressure (see ΔPef in FIG. 8) so that the refrigerant flows through the liquid refrigerant communication pipe 6 in a gas-liquid two-phase state (see the points F and G in FIG. 8) and so that the refrigerant flows through the outlet of the refrigerant cooler 35 in a liquid state (see the point E in FIG. 8).

For this reason, here, the pressure of the refrigerant flowing through the refrigerant cooler 35 is unlikely to fall, and the refrigerant can flow with a high level of wetness through the refrigerant cooler 35, and also a difference in pressure (see ΔPdj in FIG. 8) can be easily secured between the refrigerant flowing through the outdoor liquid refrigerant pipe 25 and the refrigerant flowing through the refrigerant returning pipe 31, and therefore, a cooling function (see ΔQde in FIG. 8) can be adequately fulfilled in the refrigerant cooler 35. Moreover, here, it is possible to increase the flow rate of the refrigerant to be returned into the middle of the compression process in the compressor 21 (see the point J in FIG. 8) via the refrigerant returning pipe 31, and therefore, the power consumption of the compressor 21 (see Wab in FIG. 8) also can be lowered. Consequently, it is possible to lower the flow rate of the refrigerant to be sent to the plurality of indoor units 5*a* and 5*b* and to decrease the loss in pressure in the gas refrigerant communication pipe 7 and the like (see ΔPai in FIG. 8), and therefore, improving the refrigeration capacity (see ΔQhi in FIG. 8) and operating efficiency (the value obtained by dividing ΔQhi by Wab).

In this manner, even with the configuration of this modified example, in the air conditioner 1 including the refrigerant circuit 10 configured by connecting, via the liquid refrigerant communication pipe 6 and the gas refrigerant communication pipe 7, the outdoor unit 2 having the compressor 21 and the outdoor heat exchanger 24, and the plurality of indoor units 5*a* and 5*b* having the indoor expansion valves 51*a* and 51*b* and the indoor heat exchangers 52*a* and 52*b*, reduction in the amount of the refrigerant to be filled into the refrigerant circuit 10 can be achieved while the refrigeration capacity and operating efficiency are improved by the refrigerant returning pipe 31 and the refrigerant cooler 35.

<E>

In the embodiment and Modified examples A to D described above, the present invention is applied to the configuration having the refrigerant circuit 10 for performing a cooling operation as an example, but the present invention is not limited thereto, and it is possible to apply the present invention to any configuration for performing at least a cooling operation, including a configuration that includes a four-path switching valve in the outdoor unit 2 and has a refrigerant circuit so as to enable switching between a cooling operation and a heating operation. In addition, here, an air heat source type outdoor unit that has the outdoor fan 29 for supplying outside air as a heat source to be used in heat exchange with the refrigerant to the outdoor heat exchanger 24 is adopted as the outdoor unit 2, but the outdoor unit 2 is not limited thereto, and a water heat source type outdoor unit may be used as the outdoor unit 2 which does not have the outdoor fan 29 and uses water as a heat source to be used in heat exchange with the refrigerant in the outdoor heat exchanger 24.

INDUSTRIAL APPLICABILITY

The present invention is widely applicable to an air conditioner that includes a refrigerant circuit configured by connecting, via a liquid refrigerant communication pipe and a gas refrigerant communication pipe, an outdoor unit having a compressor and an outdoor heat exchanger and a plurality of indoor units each having an indoor expansion valve and an indoor heat exchanger, and a refrigerant filled into the refrigerant circuit is circulated through in the sequence of the compressor, the outdoor heat exchanger, the liquid refrigerant communication pipe, the indoor expansion valve, the indoor heat exchanger, the gas refrigerant communication pipe, and the compressor.

REFERENCE SIGNS LIST

1 Air conditioner
2 Outdoor unit
5*a*, 5*b* Indoor unit
6 Liquid refrigerant communication pipe
7 Gas refrigerant communication pipe
8 Controller
10 Refrigerant circuit
21 Compressor
24 Outdoor heat exchanger
25 Outdoor liquid refrigerant pipe
31 Refrigerant returning pipe
35 Refrigerant cooler
36 Outdoor expansion valve
37 Liquid pressure adjusting expansion valve
42 Liquid-side outdoor heat exchange sensor
44 Refrigerant cooling-side sensor
51*a*, 51*b* Indoor expansion valve
52*a*, 52*b* Indoor heat exchanger

CITATION LIST

Patent Literature

[Patent Literature 1 (PLT 1)]
Japanese Unexamined Patent Application Publication No. S63-197853
[Patent Literature 2 (PLT 2)]
Japanese Unexamined Patent Application Publication No. H5-332630
[Patent Literature 3 (PLT 3)]
Japanese Unexamined Patent Application Publication No. 2010-236834

The invention claimed is:

1. An air conditioner comprising:

a refrigerant circuit configured by connecting, via a liquid refrigerant communication pipe and a gas refrigerant communication pipe, an outdoor unit having a compressor and an outdoor heat exchanger, and a plurality of indoor units each having an indoor expansion valve and an indoor heat exchanger, with a refrigerant filled into the refrigerant circuit being circulated through in the sequence of the compressor, the outdoor heat exchanger, the liquid refrigerant communication pipe, the indoor expansion valve, the indoor heat exchanger, the gas refrigerant communication pipe, and the compressor, wherein an outdoor liquid refrigerant pipe connecting a liquid-side end of the outdoor heat exchanger and the liquid refrigerant communication pipe is connected to a refrigerant returning pipe that branches off a portion of the refrigerant flowing through the outdoor liquid refrigerant pipe and returns the portion of the refrigerant to the compressor, and the outdoor liquid refrigerant pipe is provided with a refrigerant cooler configured to cool the refrigerant flowing through the outdoor liquid refrigerant pipe using the refrigerant flowing through the refrigerant returning pipe, wherein a liquid pressure adjusting expansion valve configured to reduce a pressure of the refrigerant is located in the outdoor liquid refrigerant pipe at a part thereof between the liquid refrigerant communication pipe and the refrigerant cooler so that the refrigerant flows through the liquid refrigerant communication pipe in a gas-liquid two-phase state and so that the refrigerant flows through an outlet of the refrigerant cooler in a liquid state, wherein the refrigerant becomes a liquid state in the outdoor heat exchanger by releasing its heat through heat exchange with outside air during a cooling operation, wherein an outdoor expansion valve configured to reduce the pressure of the refrigerant is located in the outdoor liquid refrigerant pipe at a part thereof between the outdoor heat exchanger and the refrigerant cooler, wherein a liquid-side outdoor heat exchange sensor configured to detect a temperature of the refrigerant at the liquid-side end of the outdoor heat exchanger is located in the outdoor liquid refrigerant pipe at a part thereof between the outdoor heat exchanger and the outdoor expansion valve, wherein the outdoor unit and/or the plurality of indoor units have a controller that is configured to control the liquid pressure adjusting expansion valve, wherein the controller is configured to obtain a subcooling degree of the refrigerant at the liquid-side end of the outdoor heat exchanger from the temperature of the refrigerant detected by the liquid-side outdoor heat exchange sensor, and adjust the outdoor expansion valve to reduce the pressure of the refrigerant so that the subcooling degree of the refrigerant at the liquid-side end of the outdoor heat exchanger reaches a target subcooling degree during the cooling operation, and wherein the controller is further configured to adjust the liquid pressure adjusting expansion valve to reduce the pressure of the refrigerant so that the refrigerant flows through the liquid refrigerant communication pipe in the gas-liquid two-phase state and so that the refrigerant flows through the outlet of the refrigerant cooler in the liquid state during the cooling operation.

2. The air conditioner according to claim 1, further comprising:

a refrigerant cooling-side sensor that is located in the outdoor liquid refrigerant pipe at a part thereof between the outdoor heat exchanger and the liquid pressure adjusting expansion valve.

3. The air conditioner according to claim 2, wherein the refrigerant cooling-side sensor is configured to detect a pressure of the refrigerant or a state quantity equivalent to the pressure, and the controller is further configured to obtain the pressure of the refrigerant in the outdoor liquid refrigerant pipe at the part thereof provided with the refrigerant cooler from the pressure of the refrigerant or the state quantity equivalent to the pressure detected by the refrigerant cooling-side sensor.

4. The air conditioner according to claim 1, wherein when the controller controls the opening degree of the liquid pressure adjusting expansion valve such that the pressure of the refrigerant in the outdoor liquid refrigerant pipe at the part thereof provided with the refrigerant cooler reaches a target liquid pressure, the controller controls the liquid pressure adjusting expansion valve in a range of a lower limit opening degree or higher, and revises the lower limit opening degree according to the opening degree of the outdoor expansion valve.

5. The air conditioner according to claim 1, wherein the refrigerant returning pipe is a refrigerant pipe that sends the refrigerant branched off from the outdoor liquid refrigerant pipe to a suction side of the compressor.

6. The air conditioner according to claim 1, wherein the refrigerant returning pipe is a refrigerant pipe that sends the refrigerant branched off from the outdoor liquid refrigerant pipe into a middle of a compression process in the compressor.

7. The air conditioner according to claim 2, wherein the outdoor expansion valve is located in the outdoor liquid refrigerant pipe at a part thereof closer to the outdoor heat exchanger than to the refrigerant cooler, the controller is further configured to adjust the opening degree of the liquid pressure adjusting expansion valve such that the pressure of the refrigerant in the outdoor liquid refrigerant pipe at the part thereof provided with the refrigerant cooler reaches a target liquid pressure.

8. The air conditioner according to claim 2, wherein the refrigerant returning pipe is a refrigerant pipe that sends the refrigerant branched off from the outdoor liquid refrigerant pipe to a suction side of the compressor.

9. The air conditioner according to claim 2, wherein the refrigerant returning pipe is a refrigerant pipe that sends the refrigerant branched off from the outdoor liquid refrigerant pipe into a middle of a compression process in the compressor.

* * * * *